US006314718B1

(12) United States Patent
Schneider

(10) Patent No.: US 6,314,718 B1
(45) Date of Patent: Nov. 13, 2001

(54) REDUCED TOXICITY FUEL SATELLITE PROPULSION SYSTEM INCLUDING FUEL CELL REFORMER WITH ALCOHOLS SUCH AS METHANOL

(75) Inventor: Steven J. Schneider, Rocky River, OH (US)

(73) Assignee: The United States of America as represented by the Administrator of the National Aeronautics and Space Administration, Washington, DC (US)

( * ) Notice: Subject to any disclaimer, the term of this patent is extended or adjusted under 35 U.S.C. 154(b) by 0 days.

(21) Appl. No.: 09/837,819

(22) Filed: Apr. 17, 2001

Related U.S. Application Data

(62) Division of application No. 09/291,883, filed on Apr. 14, 1999, now Pat. No. 6,272,846.

(51) Int. Cl.[7] ..... C06D 5/04
(52) U.S. Cl. ..... 60/218; 60/723; 244/172
(58) Field of Search ..... 60/39.06, 211, 60/212, 217, 218, 723; 244/169, 172

(56) References Cited

U.S. PATENT DOCUMENTS

| | | | |
|---|---|---|---|
| 2,993,768 | | 7/1961 | Holzl . |
| 3,043,099 | | 7/1962 | Wilson . |
| 3,098,350 | | 7/1963 | Barry . |
| 3,103,456 | | 9/1963 | Lawton . |
| 3,121,992 | | 2/1964 | Zwicky . |
| 3,552,126 | | 1/1971 | Ahlert . |
| 4,027,476 | | 6/1977 | Schmidt . |
| 4,583,361 | | 4/1986 | Genovese . |
| 4,620,415 | | 11/1986 | Schmidt . |
| 4,635,885 | | 1/1987 | Hujsak . |
| 5,077,257 | * | 12/1991 | Baldi ..... 502/301 |
| 5,117,627 | | 6/1992 | Runavot . |
| 5,533,331 | | 7/1996 | Campbell . |
| 5,932,837 | | 8/1999 | Rusek . |
| 5,935,489 | * | 8/1999 | Hershkowitz et al. ..... 252/373 |

FOREIGN PATENT DOCUMENTS 789960 1/1958 (GB) .

* cited by examiner

*Primary Examiner*—Charles G. Freay
(74) *Attorney, Agent, or Firm*—Kent N. Stone

(57) ABSTRACT

A reduced toxicity fuel satellite propulsion system including a reduced toxicity propellant supply (10) for consumption in an axial class thruster (14) and an ACS class thruster (16). The system includes suitable valves and conduits (22) for supplying the reduced toxicity propellant to the ACS decomposing element (26) of an ACS thruster. The ACS decomposing element is operative to decompose the reduced toxicity propellant into hot propulsive gases. In addition the system includes suitable valves and conduits (18) for supplying the reduced toxicity propellant to an axial decomposing element (24) of the axial thruster. The axial decomposing element is operative to decompose the reduced toxicity propellant into hot gases. The system further includes suitable valves and conduits (20) for supplying a second propellant (12) to a combustion chamber (28) of the axial thruster, whereby the hot gases and the second propellant auto-ignite and begin the combustion process for producing thrust.

6 Claims, 21 Drawing Sheets

REDUCED TOXICITY FUEL SATELLITE PROPULSION SYSTEM INCLUDING FUEL CELL REFORMER WITH ALCOHOLS SUCH AS METHANOL

This is a divisional of application Ser. No. 09/291,883, which was filed on Apr. 14, 1999 now U.S. Pat. No. 6,272,846.

ORIGIN OF THE INVENTION

The invention described herein was made by an employee of the United States Government and may be manufactured and used by or for the Government for governmental purposes without payment of royalties thereon or therefor.

TECHNICAL FIELD

This invention relates to a new propulsion system for satellites. Specifically this invention relates to a reduced toxicity satellite fuel that can be used for both the maneuvering and station-keeping propulsion systems of a satellite.

BACKGROUND ART

Current satellite propulsion systems typically use nitrogen tetroxide with hydrazine in bipropellant class thrusters for maneuvering propulsion and use hydrazine in monopropellant class thrusters for stationkeeping propulsion. Unfortunately these satellite propellants are highly toxic and therefore, require special handling, transportation, and storage mechanisms, which add substantial cost to the deployment of satellites.

One of the goals of NASA's Discovery Program for new planetary exploration missions, is to substantially reduce total mission cost while improving performance. The performance and cost of the on-board propulsion system for satellites can be a significant factor in obtaining the highest possible science value per unit cost.

Consequently there exists a need for lower cost reduced toxicity fuels with thrust per unit mass flow and density characteristics that are sufficient to replace prior art toxic fuels. Reduced toxicity fuels have not been used in the past, due to the fact that candidate fuels are not hypergolic. In other words, liquid reduced toxicity fuels will not spontaneously react with an oxidizer to begin the combustion process as in prior art fuels such as hydrazine.

Thus, to produce a bipropellant satellite thruster for use with a reduced toxicity fuel, there further exists a need for the thruster to have an ignition element consisting of decomposing elements for decomposing a reduced toxicity propellant into hot gases. These hot gases, like hypergolic toxic liquid fuels will spontaneously react with an oxidizer and begin the combustion process.

In addition to being used with bipropellant class thrusters, there is a further need for this reduced toxicity fuel to be used with monopropellant class thrusters. As a monopropellant, the reduced toxicity fuel must have a molecular structure that will decompose into low molecular weight gases without the formation of a solid constituent such as graphite. These monopropellant thrusters must also contain decomposing elements for reforming the reduced toxicity fuel into propellant gases. Satellite fuels that can be used as both a monopropellant and a bipropellant are referred to as dual-mode fuels.

DISCLOSURE OF INVENTION

It is an object of the present invention to provide a reduced toxicity propellant for use in satellite propulsion.

It is a further object of the present invention to provide a satellite thruster with the ability to catalytically decompose a reduced toxicity propellant into hot gases.

It is a further object of the present invention to provide a satellite thruster with the ability to decompose a reduced toxicity propellant into hot gases with a fuel cell reformer.

It is a further object of the present invention to provide a satellite thruster with a low weight plasmatron capable of decomposing a reduced toxicity propellant into hot gases without overheating and eroding portions of the plasmatron.

It is a further object of the present invention to provide a reduced toxicity dual-mode propellant that can be used in both bipropellant and monopropellant satellite propulsion systems.

Further objects of the present invention will be made apparent in the following Best Modes for Carrying Out Invention and the appended claims.

The foregoing objects are accomplished in one preferred embodiment of the invention by replacing the toxic fuel used in prior art satellite propulsion systems with a reduced toxicity liquid fuel such as methylamine. The thrusters in the present invention include a decomposing element for converting the reduced toxicity fuel into hot gases. These decomposing elements are included in both the monopropellant altitude control system (ACS) thrusters for stationkeeping and the bipropellant axial thrusters for maneuvering the satellite.

In the ACS thrusters, these decomposing elements are operative to decompose the reduced toxicity liquid propellant into propellant gases. In the axial thrusters the decomposing elements are operative to decompose the liquid reduced toxicity propellant into hot gases which auto-ignite with the second propellant in the combustion chamber of the axial thruster and thereby produce thrust when ejected through a nozzle. The difference between the thrusters is primarily their thrust class or the force generated during firing. The monopropellant ACS thrusters are in a smaller thrust class than the bipropellant axial thrusters because they are required to satisfy a minimum impulse-bit (thrust times time) requirement for precision pointing of the satellite.

The prior art uses a toxic propellant such as hydrazine in both the monopropellant ACS thrusters and bipropellant axial thrusters. Hydrazine is a hypergolic fuel, which means it will spontaneously react with an oxidizer such as nitrogen tetroxide in the liquid state thereby triggering the combustion process in prior art axial thrusters. Unfortunately, as discussed above, reduced toxicity propellants suitable for use with satellite propulsion are not hypergolic. Before the reduced toxicity propellants of the present embodiment will react with a second propellant, they must be decomposed into hot gases. These hot gases will auto-ignite with the second propellant and thereby begin the combustion process.

Propellants can be decomposed by a number of different technologies, including the use of catalytic decomposing elements, fuel cell reformers, and plasmatrons. Each of these decomposing elements is suitable for different reduced toxicity propellants. For example, the amine, methylamine, the nitroparaffin, nitromethane, and the ether, ethylene oxide, can be catalytically decomposed. Alcohols such as methanol and ethanol, and saturated hydrocarbons such as methane can be decomposed with fuel cell reformers. Saturated hydrocarbons such as pentane and octane and jet engine fuels such as kerosene and JP-10 can be decomposed with a plasmatron. Other embodiments use unsaturated hydrocarbons such as 1-pentene, ring compounds such as cyclopropane, and strained ring compounds such as quadricyclane.

In the preferred embodiment of the invention the second propellant is an oxidizer such as nitrogen tetroxide, liquid oxygen, hydrogen peroxide, or oxygen difluoride. Although oxygen difluoride is highly toxic and must be handled as a mild cryogen on the ground, it represents a high performance option. Although hydrogen peroxide has a rather high toxicity, it has unique characteristics in that it is an unstable molecule that can be catalytically decomposed into hot oxygen rich gas. Thus hydrogen peroxide is suitable in use as both a monopropellant in the ACS thrusters and as an oxidizer in the axial thrusters.

In the preferred embodiment of the present invention the decomposing element of a thruster is always active decomposing the reduced toxicity fuel into hot gases. However, in alternate embodiments the decomposing elements could be used in an axial thruster to initiate the combustion process. Thereafter both propellants can be added directly to the combustion chamber and the decomposing element can be deactivated.

BEST MODES FOR CARRYING OUT INVENTION

Figure 1:
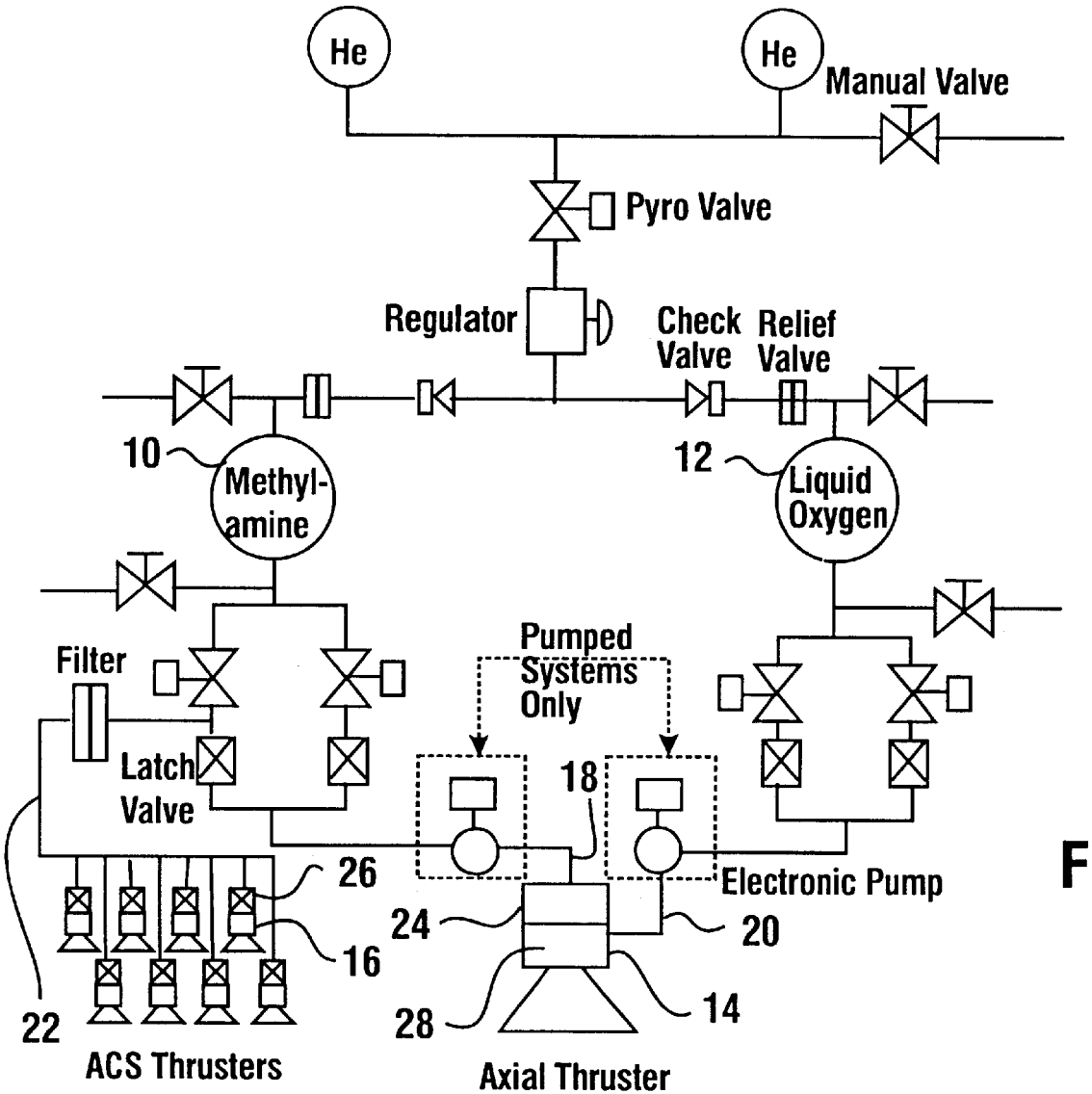
FIG. 1 is a schematic view representative of one preferred embodiment of a reduced toxicity fuel dual-mode satellite propulsion system of the present invention.

Referring now to the drawings and particularly to FIG. 1, there is shown therein a reduced toxicity satellite fuel propulsion system schematic. The system is representative of a dual-mode propulsion system that includes both an axial thruster 14 for maneuvering the satellite and an ACS thruster 16 for stationkeeping. These thrusters are designed for different thrust classes (force generated during firing). The ACS thrusters are in a smaller thrust class than the axial thrusters because they are required to satisfy a minimum impulse-bit (thrust times time) requirement for precision pointing of the satellite.

The system includes two propellant supplies. The first propellant supply 10 in one preferred embodiment includes a reduced toxicity fuel such as methylamine. The second propellant supply 12 in one preferred embodiment includes an oxidizer such as liquid oxygen. The propulsion system includes means for selectively supplying the first propellant 18 and means for selectively supplying the second propellant 20 to the axial thruster. In one preferred embodiment, the axial thruster includes a decomposing element 24 for decomposing the first propellant into hot gases. These hot gases react with the second propellant in the combustion chamber 28 of the axial thruster 14 to initiate combustion and thereby produce thrust, when ejected through a nozzle.

The propulsion system in one preferred embodiment also includes means for selectively supplying the first propellant 22 to the ACS thruster. The ACS thruster also includes a decomposing element 26 for decomposing the first propellant into propellant gases, thereby producing thrust, when ejected through a nozzle.

The terms "means for selectively supplying" as used above and throughout this application include any type of suitable valves and conduits. Some embodiments may include filters and/or pumps. However, these supplying means are not limited to these examples or mere equivalents. They are to be construed broadly to encompass any means capable of controllably transferring propellant from one place to another.

One advantage of the present invention is the use of decomposing elements in both the ACS and axial thrusters. This increases the number of available fuels beyond the toxic fuels of the prior art. Another advantage of the present invention is that the same nontoxic propellant can be used as both a monopropellant in the ACS thrusters and as a bipropellant in the axial thrusters, thus eliminating the need for a third supply of propellant (separate supplies of monopropellant and bipropellant fuels plus a supply of an oxidizer).

It should be understood that although in FIG. 1 only a limited number of ACS and axial thrusters are shown, in other embodiments of the invention different amounts, types and combinations of thrusters may be used.

Figure 2:
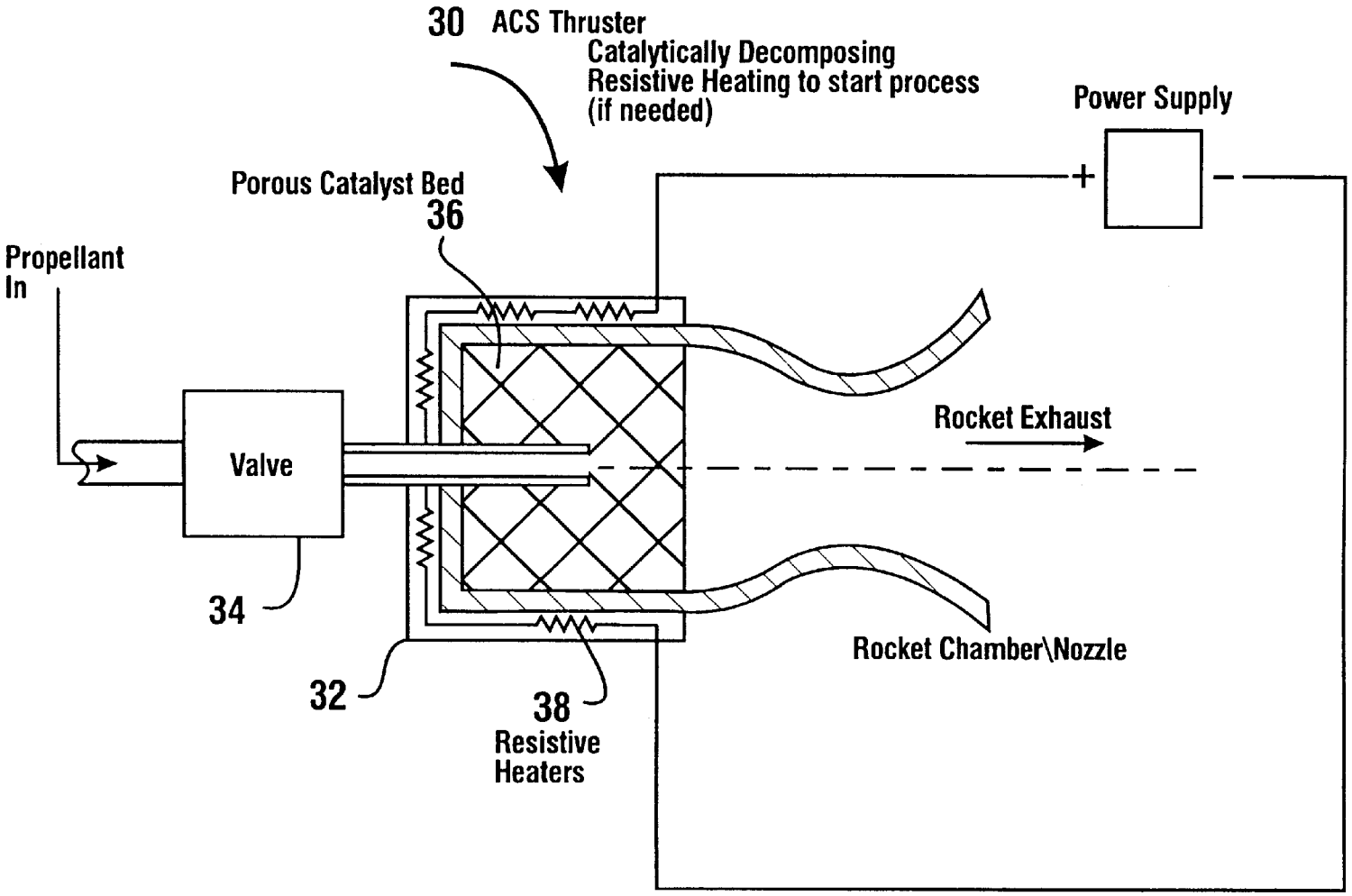
FIG. 2 is a schematic view representative of an ACS thruster that catalytically decomposes a reduced toxicity propellant in one preferred embodiment of the satellite propulsion system.

In the preferred embodiment of the present invention, the decomposing of a reduced toxicity propellant is accomplished with a catalytic decomposing element in the thrusters. FIG. 2 schematically represents one embodiment of an ACS thruster 30 which includes a catalytic decomposing element 32 for breaking apart a large molecule (stored as a liquid) propellant into smaller molecules which form a propulsive gas. The system includes means for selectively supplying the propellant 34 into a porous catalyst bed 36 of the decomposing element 32. In one embodiment of the thruster, the decomposing element also includes resistive heaters 38 which speed up the decomposition reaction.

Nontoxic or reduced toxicity propellants for use with this embodiment of the propulsion system include: amines such as, but not limited to, methylamine, nitroparaffins such as, but not limited to nitromethane, alcohols such as, but not limited to, methanol; and ethers such as, but not limited to, ethylene oxide. Although hydrogen peroxide has been listed above as a potential oxidizer for axial thrusters, hydrogen peroxide is a unique propellant that can be catalytically decomposed into a hot oxygen rich gas for use as a monopropellant in this embodiment of an ACS thruster.

Figure 3:
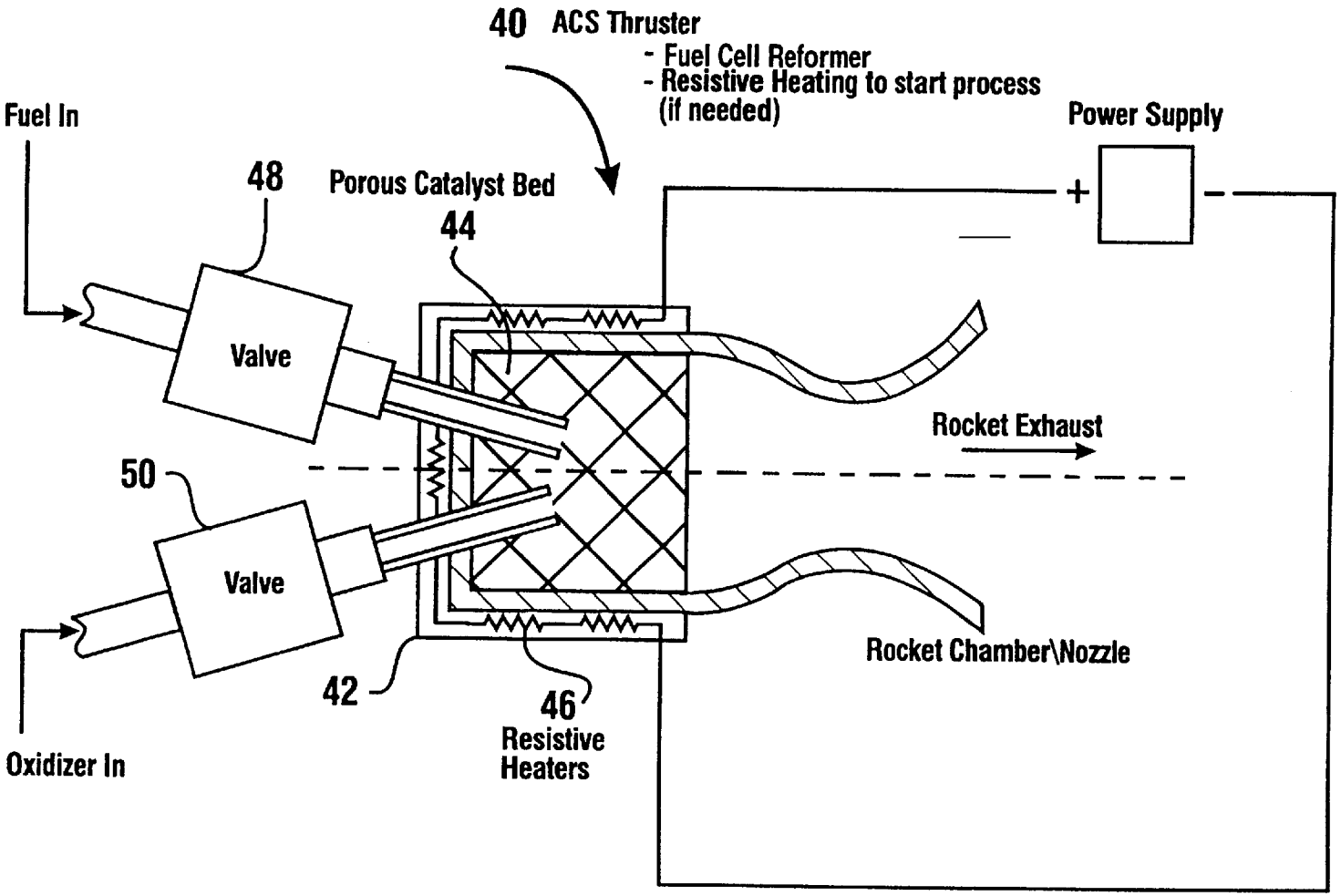
FIG. 3 is a schematic view representative of an ACS thruster with a fuel cell reformer for decomposing a reduced toxicity propellant in an alternate embodiment of the satellite propulsion system.

In an alternate embodiment of the present invention, the decomposing element of a thruster can include fuel cell reformer technology. FIG. 3 schematically represents an embodiment of the ACS thruster 40 with a fuel cell reformer 42. The fuel cell reformer in this embodiment includes a porous catalyst bed 44 with resistive heaters 46. In addition to means for supplying fuel 48 to the fuel cell reformer 42, the system also includes means for supplying a small amount of an oxidizer 50 to the catalyst bed for reforming the liquid fuel into hot hydrogen gas without the formation of solid graphitic carbon.

Any of the oxidizers listed above such as nitrogen tetroxide, liquid oxygen, hydrogen peroxide, and oxygen difluoride can be supplied to the fuel cell reformer; however, liquid oxygen is the preferred oxidizer in order to convert the carbon to carbon monoxide gas. The preferred fuels for this embodiment include: alcohols such as, but not limited to, methanol and ethanol; ethers such as, but not limited to, ethylene oxide; and saturated hydrocarbons such as, but not limited to, methane, ethane, pentane, and propane.

Figures 4A, 4B:
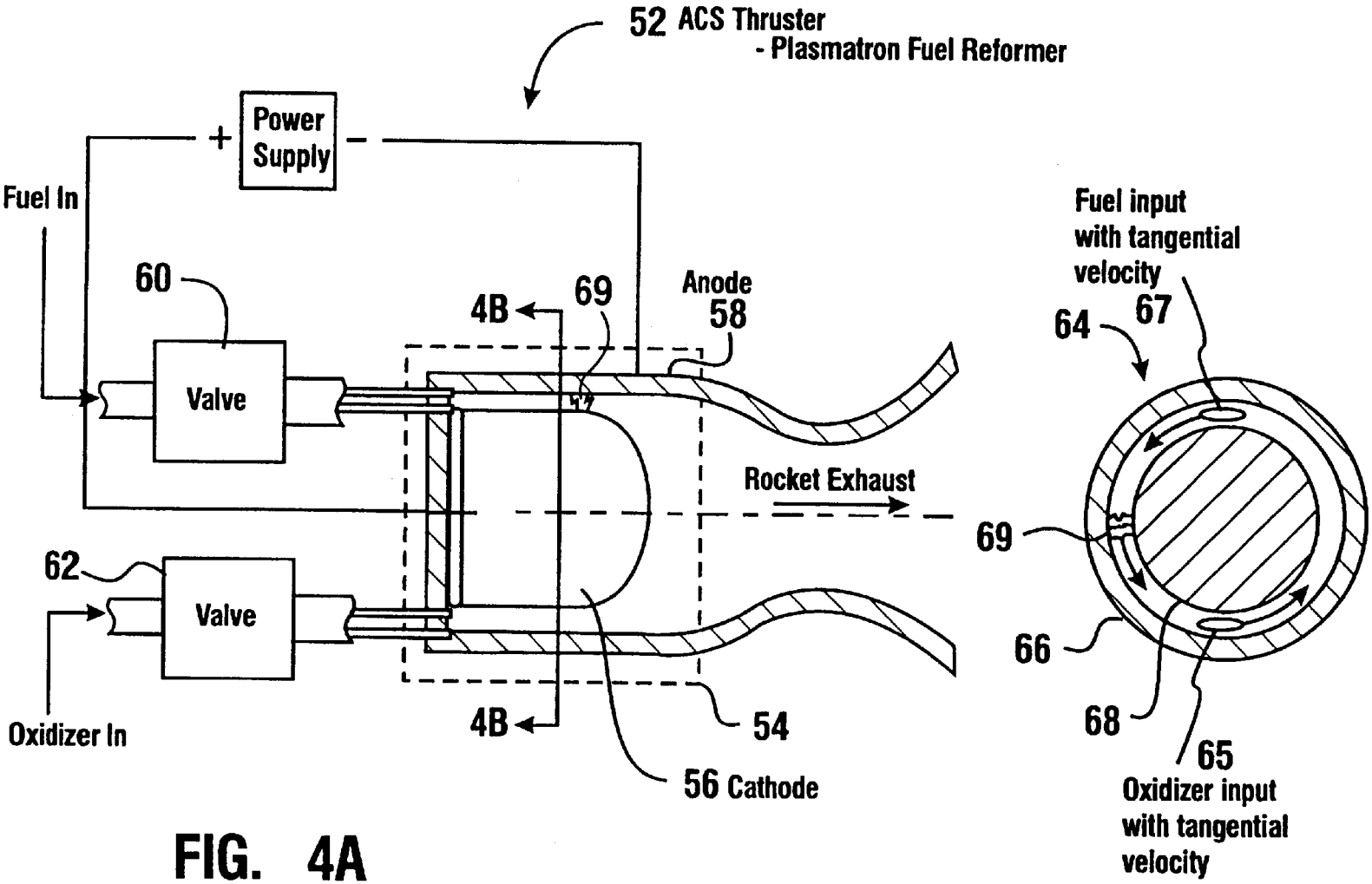
FIG. 4 is a schematic view representative of an ACS thruster with a plasmatron for decomposing a reduced toxicity propellant in an alternate embodiment of the satellite propulsion system.

FIG. 4*a* schematically represents one embodiment of the ACS thruster 52 that includes a plasmatron 54 for decomposing fuel. In this embodiment the plasmatron includes a cathode 56 inside the thruster which is electrically charged. Surrounding the cathode 56 along the inside wall of the thruster 52 is an anode 58 with the opposite polarity of the cathode 56. The system includes means for supplying both liquid fuel 60 and a small amount of oxidizer 62 between the cathode 56 and anode 58 with tangential velocity around the cathode 56. The small amount of oxidizer is added along with the fuel to produce a hydrogen rich plasma without the formation of solid graphitic carbon.

FIG. 4*b* schematically represents a cross sectional view of the ACS thruster 64 in this described embodiment. One advantage of the present configuration is that the tangential flow of the propellants from the oxidizer input 65 and fuel input 67, will cause the discharge arc 69 between the anode 66 and cathode 68 to sweep around the tip of the cathode rather than hanging up on one spot, overheating it, and sputtering material away. In alternate embodiments of the thruster, other configurations of a plasmatron can be used for decomposing the fuel to produce propellant gases. As with the fuel cell reformer represented in FIG. 3, any of the oxidizers listed above can be used in the present embodiment. However, liquid oxygen is preferred to convert the carbon to carbon monoxide.

One advantage of using a plasmatron in a thruster, is that it enables the use of a wide range of reduced toxicity fuels including: alcohols such as, but not limited to, methanol and ethanol; ethers such as, but not limited to, ethylene oxide; amines such as, but not limited to, methylamine and ethylamine; nitroparaffins such as, but not limited to, nitromethane; saturated hydrocarbons such as, but not limited to, methane, ethane, pentane, and propane; unsaturated hydrocarbons such as, but not limited to, 1-pentene and acetylene; ring compounds such as, but not limited to, JP-10 and cyclopropane; and strained ring compounds such as quadricyclane.

As discussed above, the axial thruster is designed to be in a higher thrust class than an ACS thruster. Prior art systems achieve this higher performance by combining a toxic fuel such as hydrazine with an oxidizer such as nitrogen tetroxide in a combustion chamber. Because these chemicals are hypergolic they will spontaneously react with one another in the liquid state, thereby releasing energy to begin the combustion process. The present invention improves over the prior art by allowing a reduced toxicity liquid fuel to be used in place of the prior art toxic fuels. However, candidates for reduced toxicity liquid fuels such as methylamine are not hypergolic. Rather they must be decomposed into hot gases which will auto-ignite with an oxidizer such as liquid oxygen.

FIGS. 5–10 schematically represent embodiments of axial thrusters. The thrusters shown in FIGS. 5–7 designed for a smaller thrust class could also be used as augmented ACS thrusters.

Figure 5:
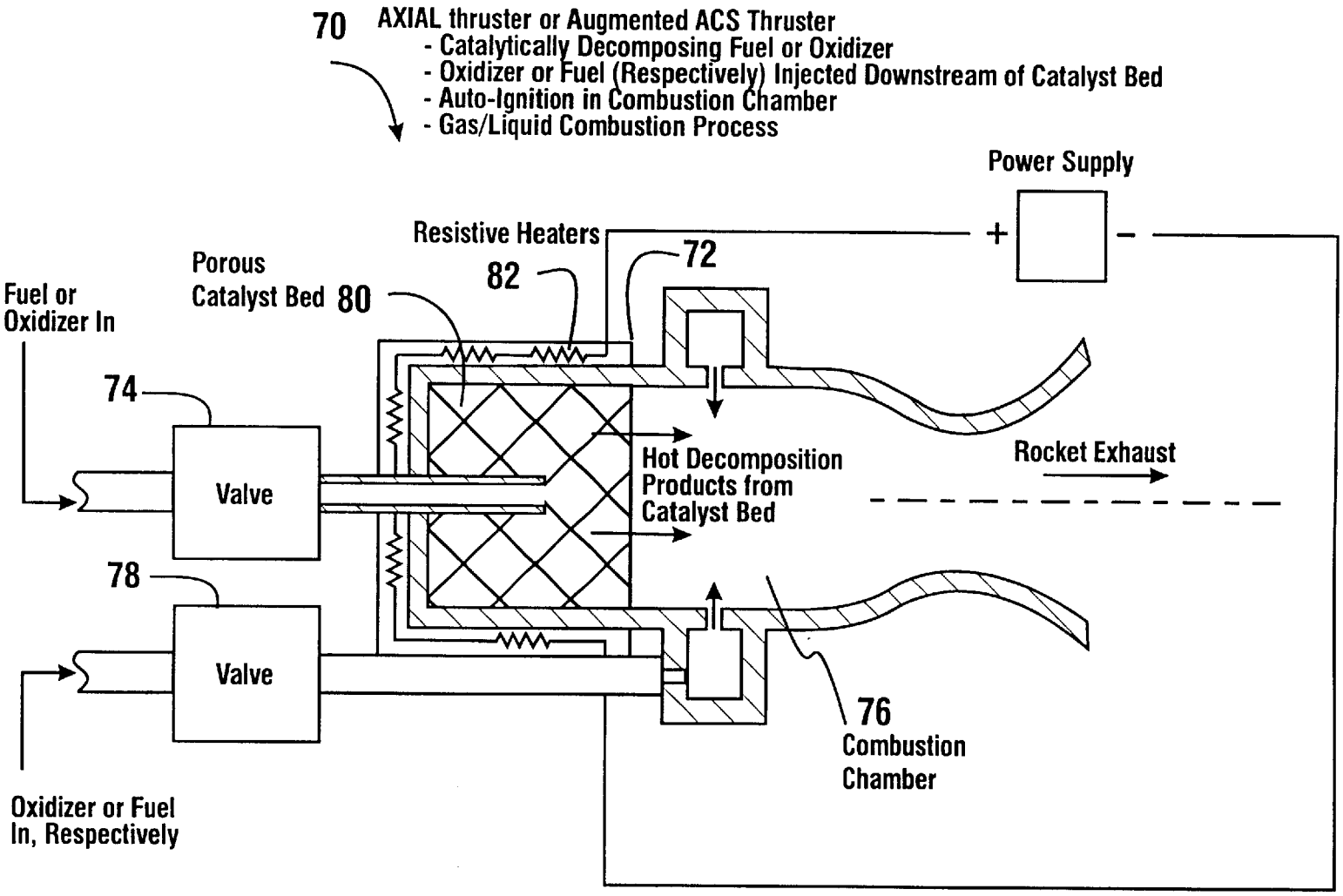
FIG. 5 is a schematic view representative of a preferred embodiment of the invention where an axial thruster or augmented ACS thruster catalytically decomposes a reduced toxicity propellant into hot gases which react with a second propellant in the combustion chamber.

FIG. 5 schematically represents an axial or augmented ACS thruster 70 that has a catalytic decomposing element 72 for decomposing a propellant into hot gases. The catalytic decomposing element 72 for this embodiment includes a porous catalyst bed 80 for receiving a propellant and may include resistive heaters 82 for speeding up the decomposition reaction. This embodiment also includes means for selectively supplying a first propellant 74 to the decomposing element 72 and means for selectively supplying a second propellant 78 directly to the combustion chamber 76 of the axial thruster 70.

In this embodiment, the propellant supplied by the first supplying means 74 can include nontoxic or reduced toxicity fuels including: amines such as, but not limited to, methylamine; nitroparaffins such as, but not limited to, nitromethane; alcohols such as, but not limited to, methanol; and ethers such as, but not limited to, ethylene oxide. The propellant supplied by the second supplying means 78 can be an oxidizer such as nitrogen tetroxide, liquid oxygen, oxygen difluoride, and hydrogen peroxide.

In an alternate form of this invention the oxidizer hydrogen peroxide is supplied by the first supplying means 74 to the catalytic decomposing element 72 and the reduced toxicity fuel is directly supplied by the second supplying means 78 to the combustion chamber 76. Thus, the oxidizer hydrogen peroxide is decomposed into a hot oxygen rich gas ready for reaction with the reduced toxicity liquid fuel in the combustion chamber.

This embodiment of the axial or augmented ACS thruster has a larger set of reduced toxicity fuels available for use as a propellant including: alcohols such as, but not limited to, methanol and ethanol; ethers such as, but not limited to, ethylene oxide; amines such as, but not limited to, methylamine and ethylamine; nitroparaffins such as, but not limited to, nitromethane; saturated hydrocarbons such as, but not limited to, methane, ethane, pentane, and propane; unsaturated hydrocarbons such as, but not limited to, 1-pentene and acetylene; ring compounds such as, but not limited to, JP-10 and cyclopropane; and strained ring compounds such as quadricyclane.

Figure 6:
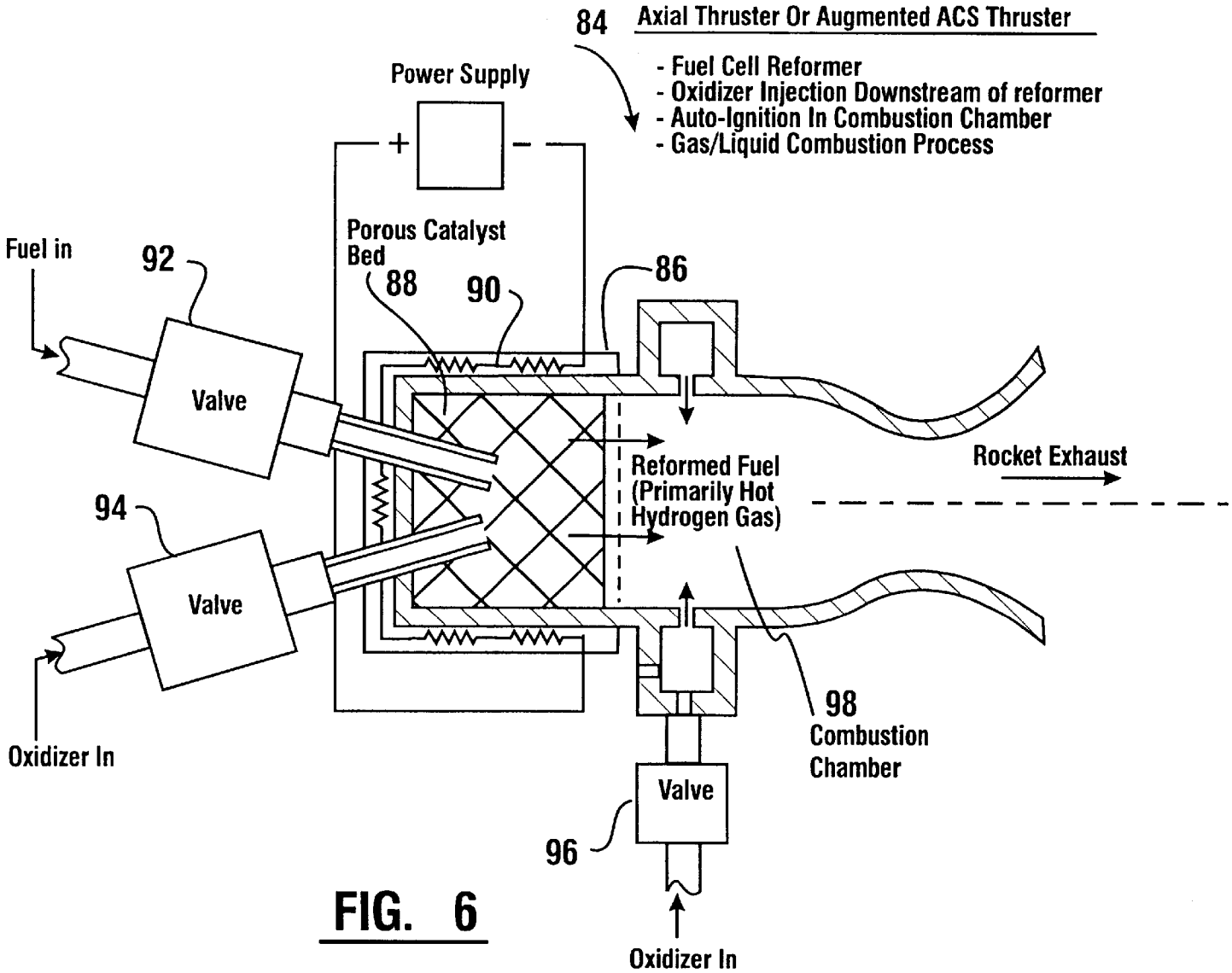
FIG. 6 is a schematic view representative of an alternate embodiment of the invention where an axial or augmented ACS thruster includes a fuel cell reformer for decomposing a reduced toxicity propellant into hot gases which react with an oxidizer propellant in the combustion chamber.

FIG. 6 schematically represents an alternate embodiment of the axial or augmented ACS thruster 84 wherein the decomposing element is a fuel cell reformer 86. The fuel cell reformer in this embodiment includes a porous catalyst bed 88 with resistive heaters 90. The system includes means for selectively supplying a small amount of an oxidizer 94 to the porous catalyst bed 88 for reforming the liquid fuel into hot hydrogen gas without the formation of solid graphitic carbon. In addition the system also includes means for selectively supplying liquid oxidizer 96 directly to the combustion chamber 98 which is downstream of hot gases released from the fuel cell reformer 86. The resulting reaction between the oxidizer and hot gases initiates the combustion process.

Oxidizers such as nitrogen tetroxide, liquid oxygen, hydrogen peroxide, and oxygen difluoride can be used in this embodiment; however, liquid oxygen is the preferred oxidizer in order to convert the carbon to carbon monoxide gas. The preferred fuels for this embodiment include: alcohols such as, but not limited to, methanol and ethanol; ethers such as, but not limited to, ethylene oxide; and saturated hydrocarbons such as, but not limited to, methane, ethane, pentane, and propane.

Figure 7:
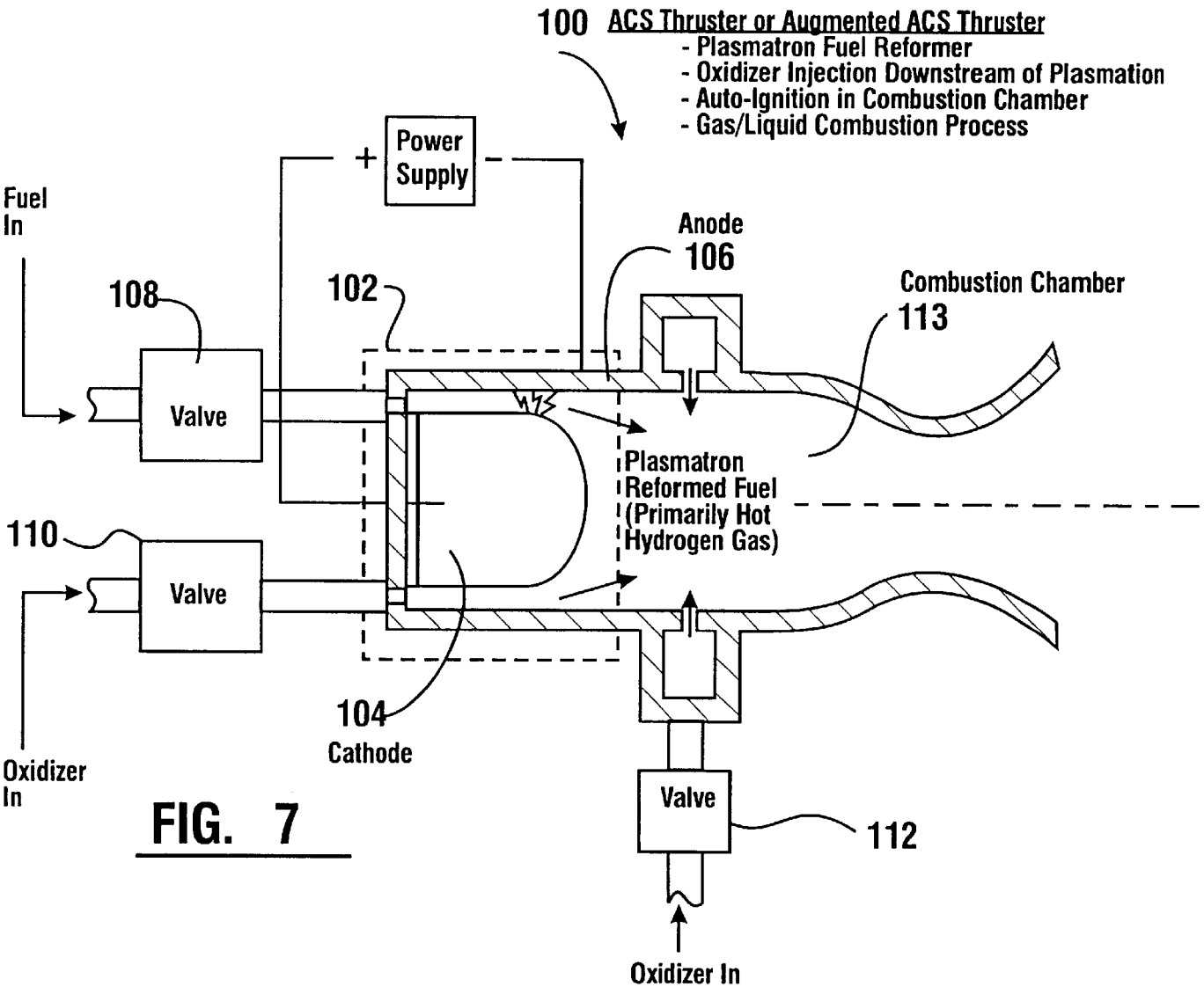
FIG. 7 is a schematic view representative of an alternate embodiment of the invention where an axial or augmented ACS thruster includes a plasmatron for decomposing a reduced toxicity propellant into hot gases which react with an oxidizer propellant in the combustion chamber.

FIG. 7 schematically represents another embodiment of the axial or augmented ACS thruster 100 that includes a plasmatron 102 for decomposing fuel. In this embodiment the plasmatron includes a cathode 104 inside the thruster which is electrically charged. Surrounding the cathode 104 forming the inside wall of the thruster 100 is the anode 106 with the opposite polarity of the cathode 104. The system includes means for supplying both liquid fuel 108 and means for supplying a small amount of oxidizer 110 between the cathode 104 and anode 106 with tangential velocity around the cathode 104. A small amount of oxidizer is added along with the fuel to produce a hydrogen rich plasma without the formation of solid graphitic carbon.

As stated above for the ACS thruster in FIG. 5, one advantage of the present configuration is that the tangential flow of the propellants will cause the discharge arc between the anode 106 and cathode 104 to sweep around the tip of the cathode 104 rather than hanging up on one spot, overheating it, and sputtering material away.

This embodiment of the axial or augmented ACS thruster includes means for selectively supplying liquid oxidizer 112 directly to the combustion chamber 113 of the thruster downstream of the hot gases formed by the plasmatron 102. The oxidizer and hot gases auto-ignite and initiate the combustion process.

For this embodiment oxidizers such as nitrogen tetroxide, liquid oxygen, hydrogen peroxide and oxygen difluoride can be used. However, liquid oxygen is preferred to convert the carbon to carbon monoxide. Reduced toxicity fuels for use with this embodiment include: alcohols such as, but not limited to, methanol and ethanol; ethers such as, but not limited to, ethylene oxide; amines such as, but not limited to, methylamine and ethylamine; nitroparaffins such as, but not limited to, nitromethane; saturated hydrocarbons such as, but not limited to, methane, ethane, pentane, and propane; unsaturated hydrocarbons such as, but not limited to, 1-pentene and acetylene; ring compounds such as, but not limited to, JP-10 and cyclopropane; and strained ring compounds such as quadricyclane.

Figure 8:
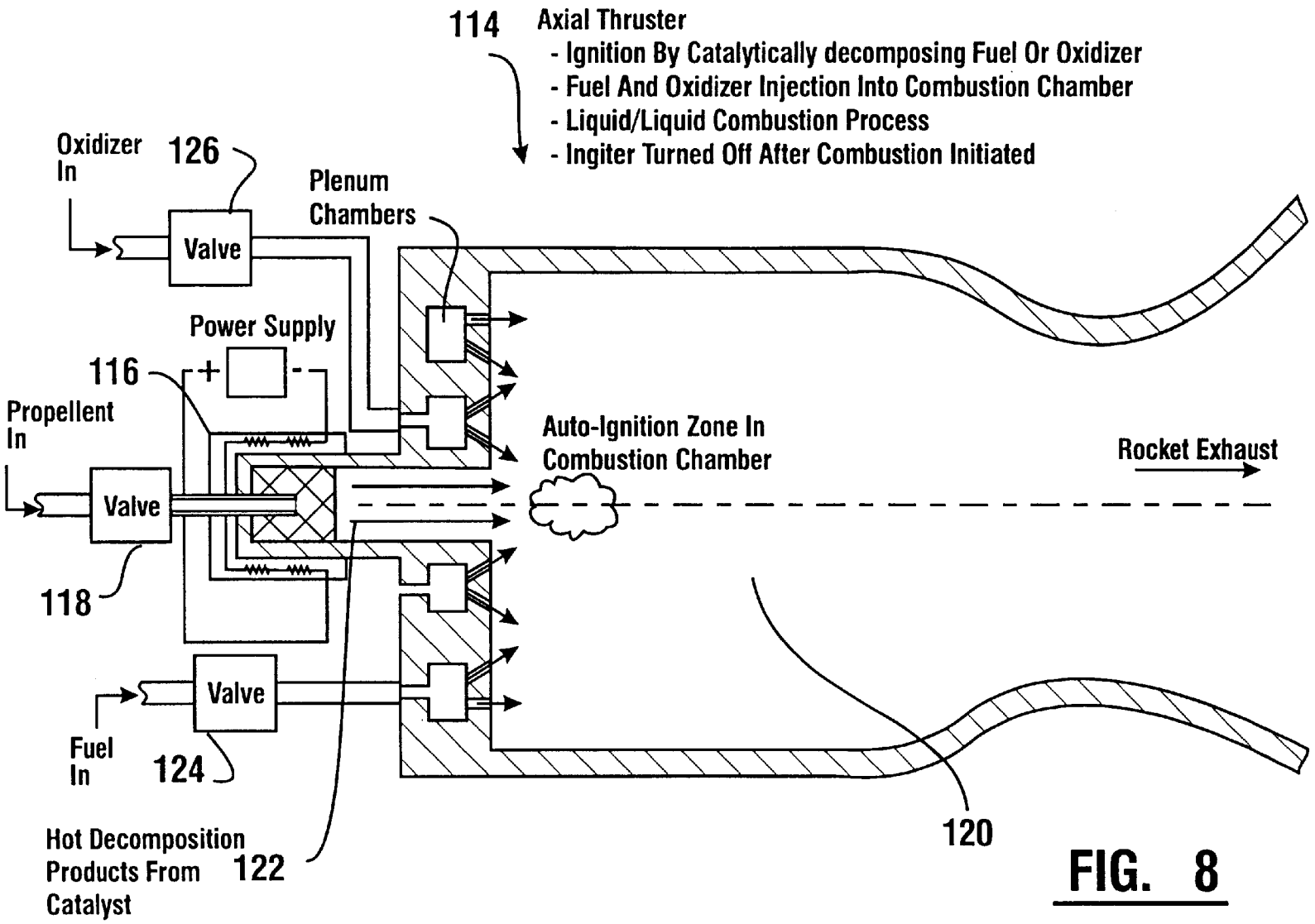
FIG. 8 is a schematic view representative of an alternate embodiment of the invention where an axial thruster catalytically decomposes a reduced toxicity propellant into hot gases which initiate the combustion of the first and second propellants in the combustion chamber.

In the above embodiments of the axial or augmented ACS thrusters, the decomposing element continues to decompose propellant into hot gases while the thruster is operating. However, in an alternate form of the axial thruster the decomposing element could be used as an ignition device which starts the combustion reaction between a reduced toxicity fuel and an oxidizer. Once the combustion process is started, the decomposing element may be deactivated. FIG. 8 schematically represents an axial thruster 114 with a catalytic decomposing element 116 for decomposing a propellant into hot gases 122. This embodiment includes both means for selectively supplying a reduced toxicity liquid fuel 124 and means for selectively supplying a liquid oxidizer 126 to the combustion chamber 120 of the axial thruster. The combustion process initiates the reaction between the hot gases 122 and the liquid propellants injected into the combustion chamber 120. Once combustion has begun the reaction between the injected oxidizer and reduced toxicity fuel will continue without the need for hot gases from the catalytic decomposing element 116. Thus, the catalytic decomposing element 116 can be turned off after ignition of the thruster.

When nitrogen tetroxide, liquid oxygen, or oxygen difluoride is used as an oxidizer in this embodiment, the reduced toxicity fuels that can be used include: amines such as, but not limited to, methylamine; nitroparaffins such as, but not limited to nitromethane; alcohols such as, but not limited to, methanol; and ethers such as, but not limited to, ethylene oxide. These same fuels can also be used as the propellant that is decomposed by the catalytic decomposing element into hot gases.

In embodiments of this axial thruster where hydrogen peroxide is used as the oxidizer, a larger set of reduced toxicity fuels can include: alcohols such as, but not limited to, methanol and ethanol; ethers such as, but not limited to, ethylene oxide; amines such as, but not limited to, methylamine and ethylamine; nitroparaffins such as, but not limited to, nitromethane; saturated hydrocarbons such as, but not limited to, methane, ethane, pentane, and propane; unsaturated hydrocarbons such as, but not limited to, 1-pentene and acetylene; ring compounds such as, but not limited to, JP-10 and cyclopropane; and strained ring compounds such as quadricyclane. In this embodiment hydrogen peroxide is used as the propellant that is decomposed by the catalytic decomposing element into hot gases.

Figure 9:
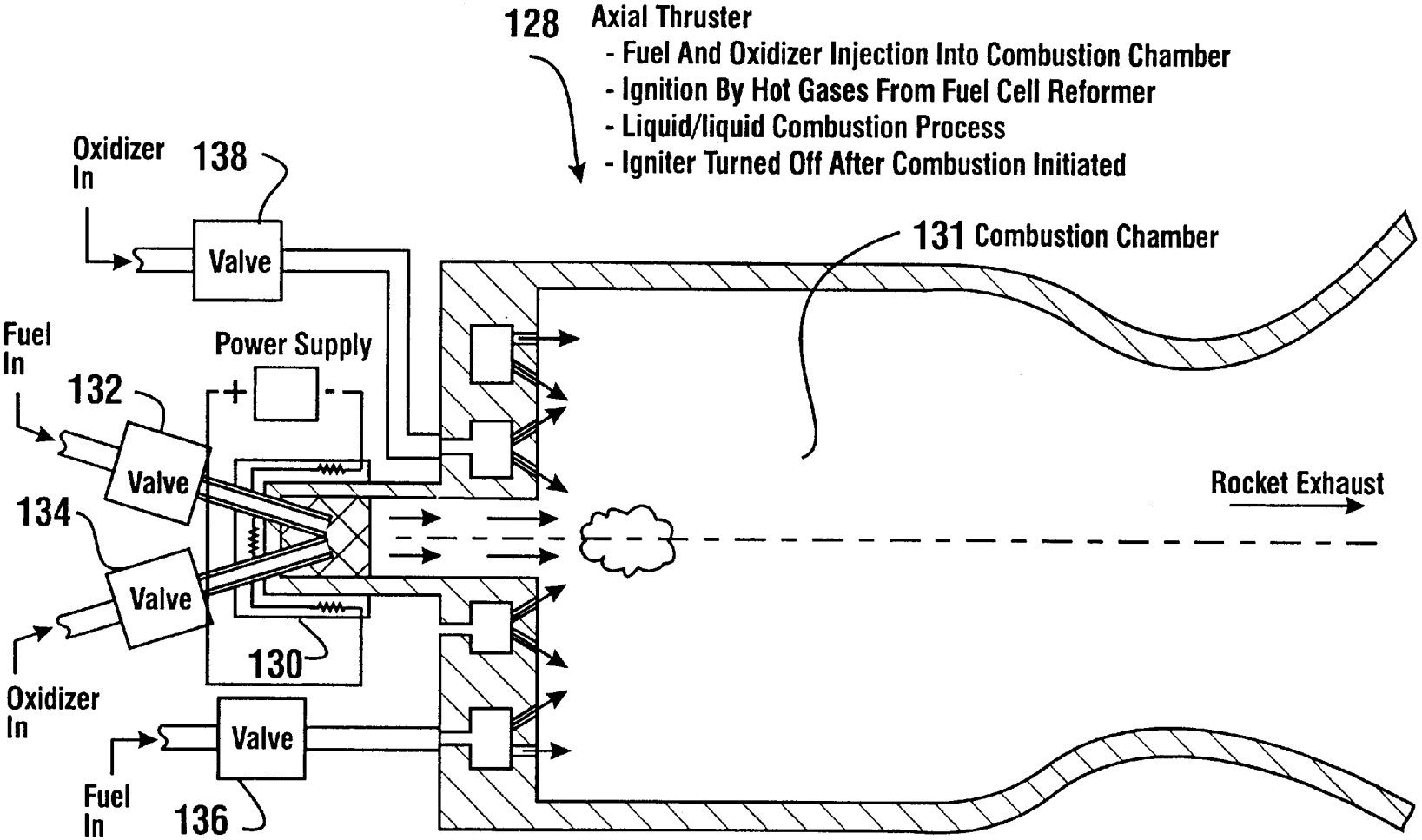
FIG. 9 is a schematic view representative of an alternate embodiment of the invention where an axial thruster includes a fuel cell reformer for decomposing a reduced toxicity propellant into hot gases which initiate the combustion of the first and second propellants in the combustion chamber.

FIG. 9 schematically represents an alternative embodiment of an axial thruster 128 with a fuel cell reformer 130 that is used to initiate the combustion process and that can be turned off once the combustion process between the reduced toxicity fuel and oxidizer is under way. The same propellant listed above for embodiments with fuel cell reformers can be used in this embodiment including: alcohols such as, but not limited to, methanol and ethanol; ethers such as, but not limited to, ethylene oxide; and saturated hydrocarbons such as, but not limited to, methane, ethane, pentane, and propane. Oxidizers for this embodiment include: nitrogen tetroxide, liquid oxygen, hydrogen peroxide, and oxygen difluoride.

Figure 10:
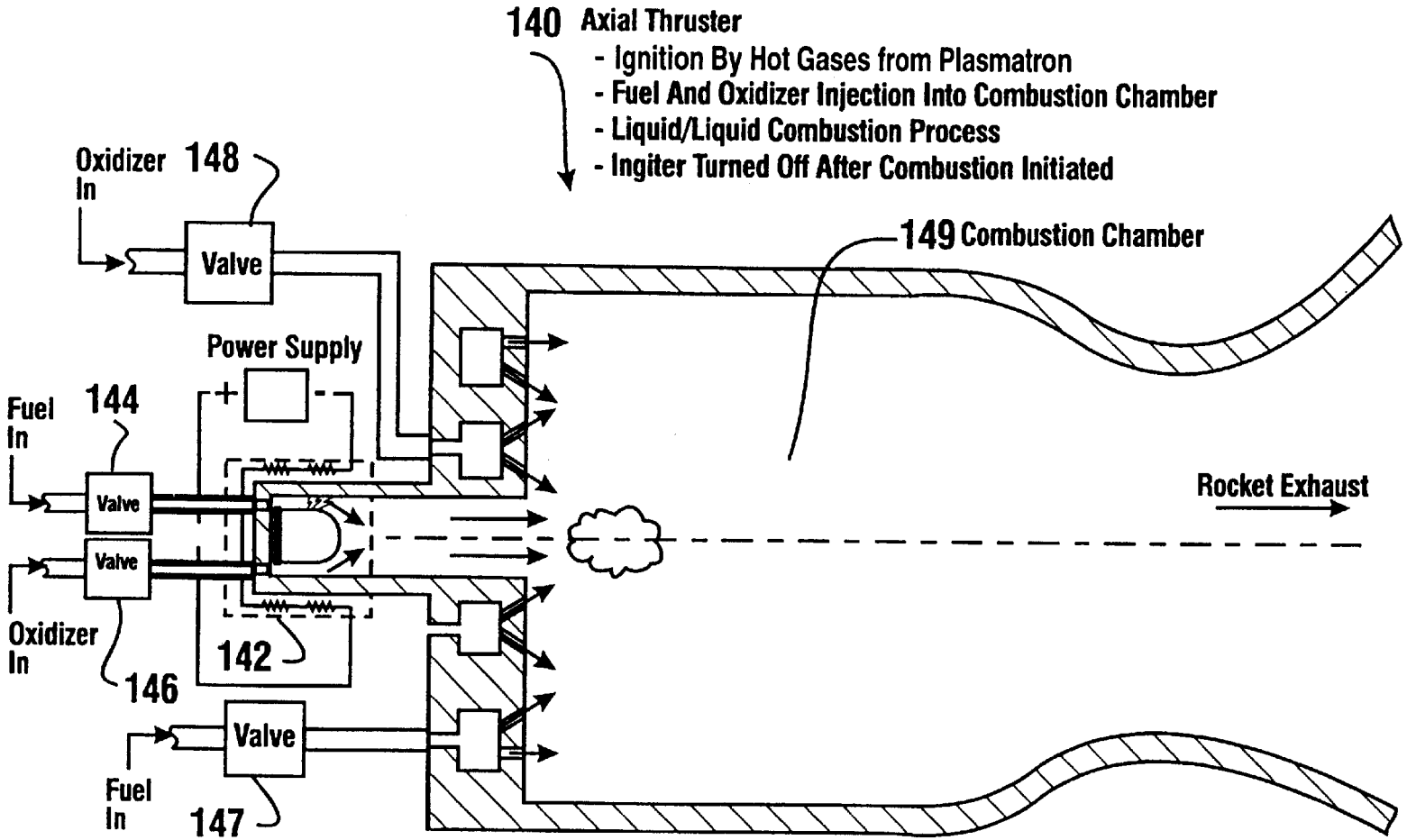
FIG. 10 is a schematic view representative of an alternate embodiment of the invention where an axial thruster includes a plasmatron for decomposing a reduced toxicity propellant into hot gases which initiate the combustion of the first and second propellants in the combustion chamber.

FIG. 10 schematically represents an alternative embodiment of an axial thruster 140 with a plasmatron 142 that is used to initiate the combustion process and that can be turned off once the combustion process between the reduced toxicity fuel and oxidizer is under way. The same propellants listed above for embodiments with plasmatrons can be used in this embodiment including: alcohols such as, but not limited to, methanol and ethanol; ethers such as, but not limited to, ethylene oxide; amines such as, but not limited to, methylamine and ethylamine; nitroparaffins such as, but not limited to, nitromethane; saturated hydrocarbons such as, but not limited to, methane, ethane, pentane, and propane; unsaturated hydrocarbons such as, but not limited to, 1-pentene and acetylene; ring compounds such as, but not limited to, JP-10 and cyclopropane; and strained ring compounds such as quadricyclane. Oxidizers for this embodiment include: nitrogen tetroxide, liquid oxygen, hydrogen peroxide, and oxygen difluoride.

Figure 11:
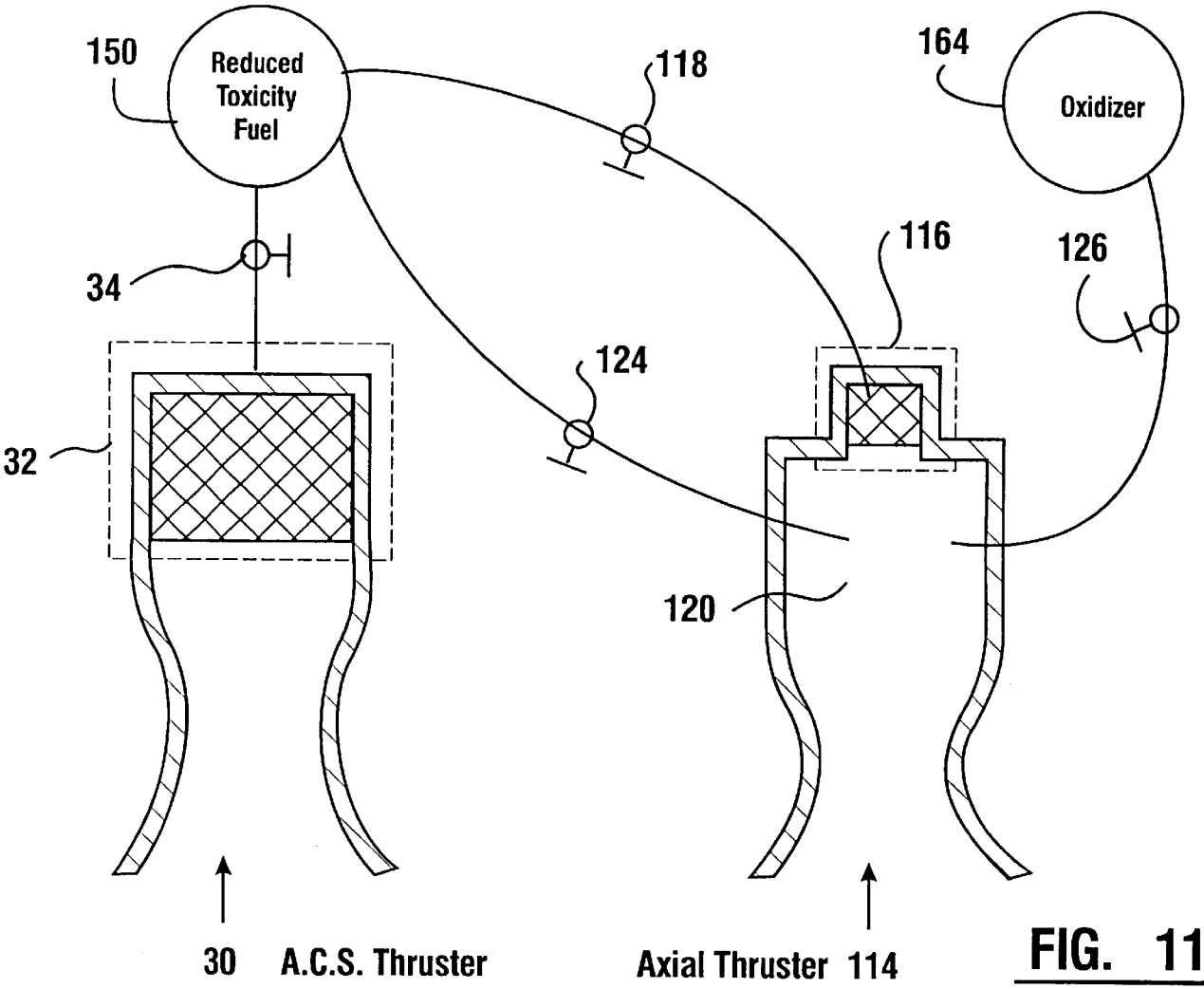
FIG. 11 is a schematic view representative of a reduced toxicity dual-mode satellite propulsion system where a reduced toxicity fuel is used in both an ACS thruster shown schematically in FIG. 2 and an axial thruster shown schematically in FIG. 8.

One advantage of the present invention is that the same reduced toxicity fuels and oxidizers can be used in both the ACS and axial thrusters. Thus, just as with some prior art toxic fuels only two supplies of propellants are required. FIG. 1 schematically represents this dual-mode propulsion system with ACS thruster 30 like that shown in FIG. 2 and axial thruster 70 like that shown in FIG. 5. However, with different embodiments of thrusters as described above, alternate embodiments of this dual-mode system exist. FIG. 11 schematically represents a reduced toxicity fuel dual-mode satellite propulsion system, where the axial thruster 114 is representative of an axial thruster like that shown in FIG. 8. Also, the ACS thruster 30 is representative of an ACS thruster like that shown in FIG. 2. In this embodiment there are means 34 for selectively supplying reduced toxicity fuel 150 to the ACS thruster 30, means 118 for selectively supplying reduced toxicity fuel to the decomposing element 116 used for ignition of the axial thruster 114, and means 124 for selectively supplying reduced toxicity fuel directly to the combustion chamber 120 of the axial thruster. The system also includes means for supplying 126 liquid oxygen 164 to the combustion chamber 120 of the axial thruster.

Figure 12B:
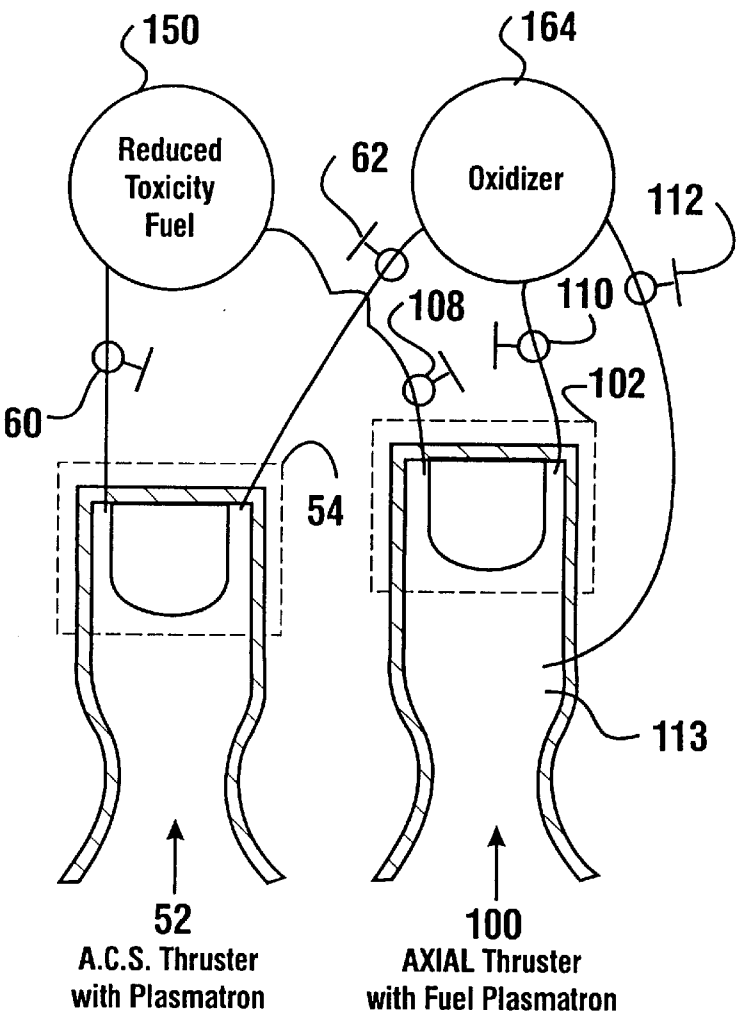
FIG. 12*b* is a schematic view representative of a reduced toxicity dual-mode satellite propulsion system where reduced toxicity propellants are used in both the ACS thruster shown schematically in FIG. 4 and the axial thruster shown schematically in FIG. 7.
Figure 12A:
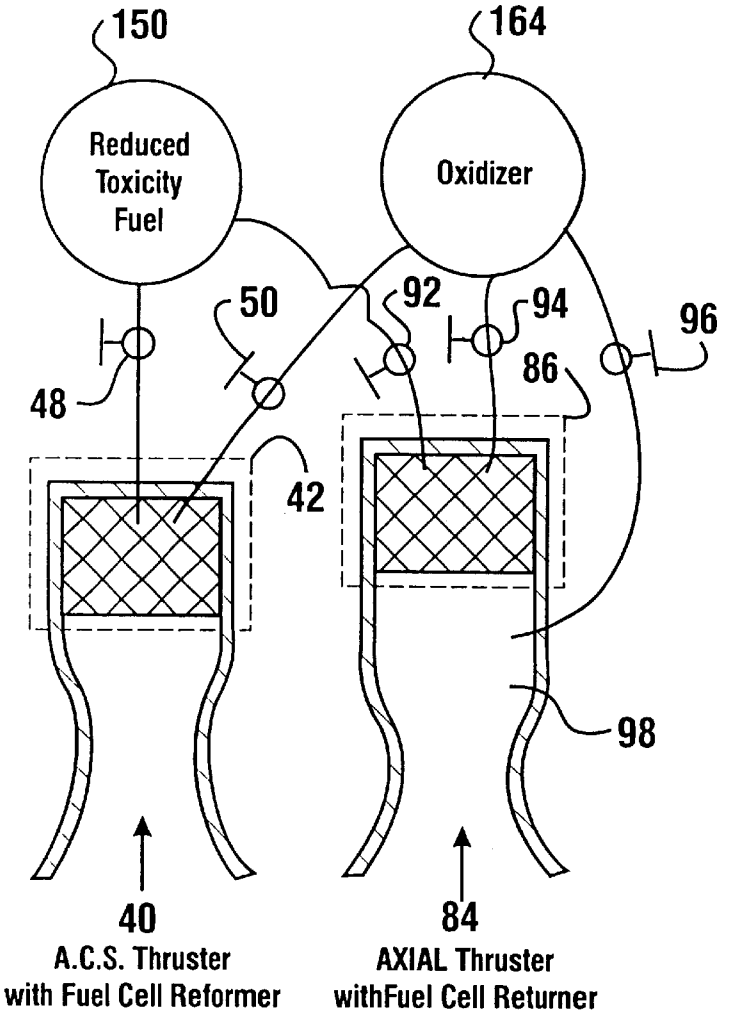
FIG. 12*a* is a schematic view representative of a reduced toxicity dual-mode satellite propulsion system where reduced toxicity propellants are used in both the ACS thruster shown schematically in FIG. 3 and the axial thruster shown schematically in FIG. 6.

FIG. 12*a* schematically represents a reduced toxicity fuel dual-mode satellite propulsion system using fuel cell reformers. The axial thruster is representative of an axial thruster 84 like that shown in FIG. 6 and the ACS thruster is representative of the ACS thruster 40 like that shown in FIG. 3. Here, there are means 48 for selectively supplying reduced toxicity fuel 150 to the fuel cell reformer 42 of the ACS thruster 40, and means 92 for selectively supplying reduced toxicity fuel to the fuel cell reformer 86 of the axial thruster 84. The system also includes means 50 for selectively supplying an oxidizer 164 to the fuel cell 42 of the ACS thruster 40 and means 94 for selectively supplying oxidizer 164 to the fuel cell 86 of the axial thruster 84. In addition the system of this embodiment also includes means 96 for selectively supplying oxidizer 164 to the combustion chamber 98 of the axial thruster.

FIG. 12*b* is a variation of the reduced toxicity fuel, dual-mode satellite propulsion system of FIG. 12*a* where a plasmatron fuel reformer is used. Here the axial thruster is representative of an axial thruster 100 like that shown in FIG. 7 and the ACS thruster is representative of the ACS thruster 52 like that shown in FIG. 4*a*. Here, there are means 60 for selectively supplying reduced toxicity fuel 150 to the plasmatron fuel reformer 54 of the ACS thruster 52, and means 108 for selectively supplying reduced toxicity fuel to the plasmatron fuel reformer 102 of the axial thruster 100. The system also includes means 62 for selectively supplying an oxidizer 164 to the plasmatron fuel reformer 54 of the ACS thruster 52 and means 110 for selectively supplying oxidizer 164 to the plasmatron fuel reformer 102 of the axial thruster 100. In addition the system of this embodiment also includes means 112 for selectively supplying oxidizer 164 to the combustion chamber 113 of the axial thruster.

Figure 13:
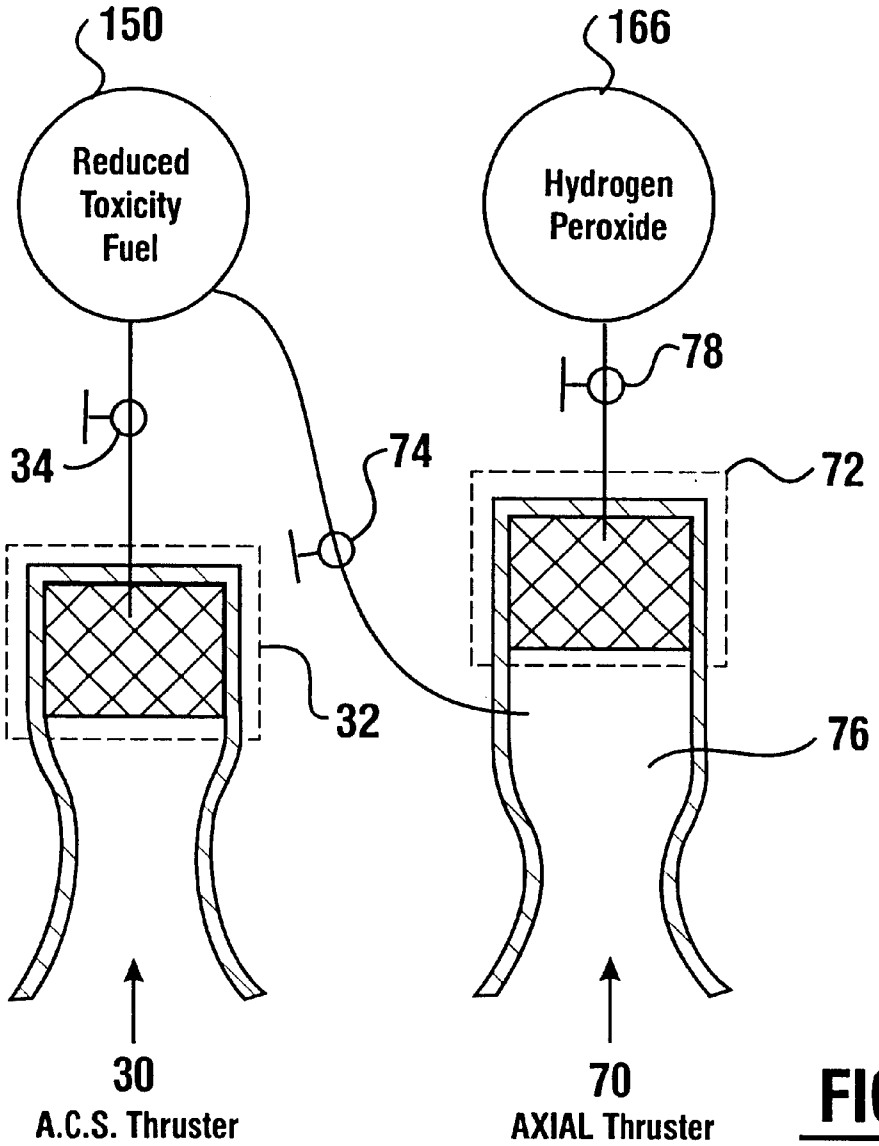
FIG. 13 is a schematic view representative of a reduced toxicity dual-mode satellite propulsion system where a reduced toxicity fuel is used in both an ACS thruster shown schematically in FIG. 2 and an axial thruster shown schematically in FIG. 5, and where the axial thruster uses hydrogen peroxide as an oxidizer in the catalytic decomposing element.

FIG. 13 is an alternate embodiment that schematically represents a reduced toxicity fuel dual-mode satellite propulsion system that uses hydrogen peroxide as an oxidizer. In this embodiment the axial thruster 70 is representative of an axial thruster like that shown in FIG. 5. Also, the ACS thruster 30 is representative of an ACS thruster like that shown in FIG. 2. In this embodiment there are means 34 for selectively supplying a reduced toxicity fuel 150 to the catalytic decomposing element 32 of the ACS thruster 30, and means 74 for selectively supplying reduced toxicity fuel 150 directly to the combustion chamber 76 of the axial thruster 70. The system also includes means 78 for selectively supplying the oxidizer hydrogen peroxide 166 to the catalytic decomposing element 72 of the axial thruster 70.

Figure 14:
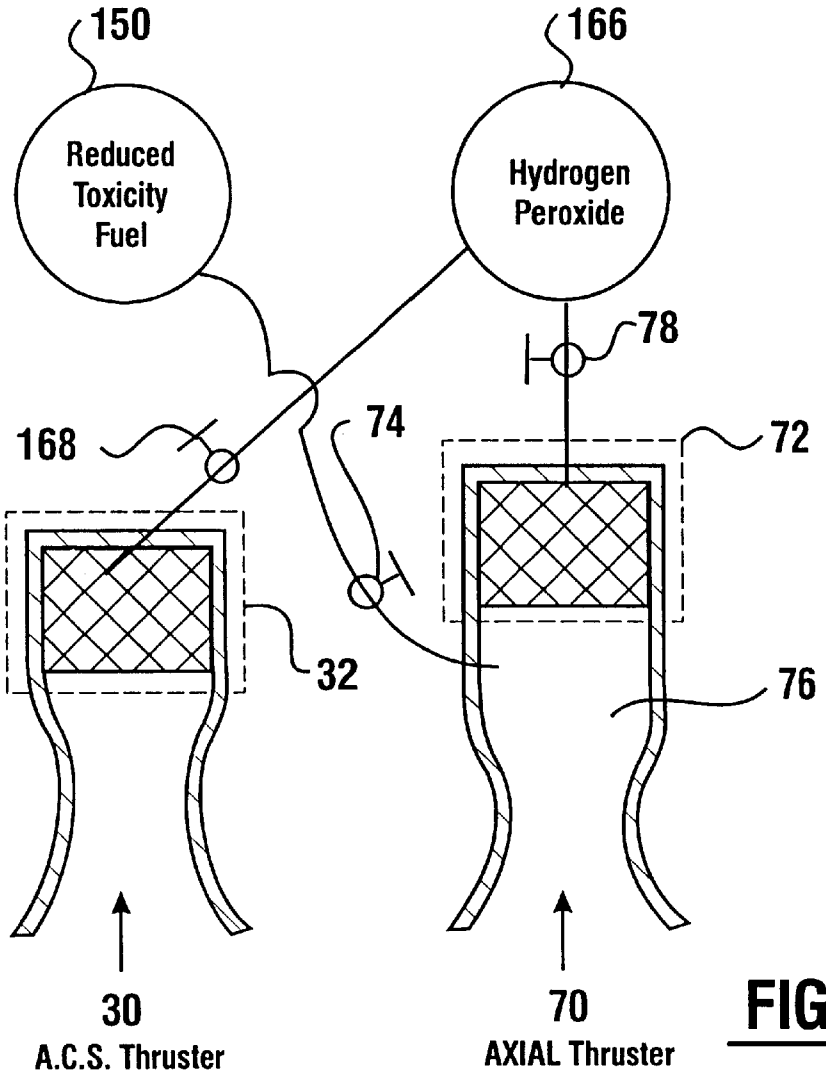
FIG. 14 is a schematic view representative of a reduced toxicity dual-mode satellite propulsion system with hydrogen peroxide as an oxidizer in both the axial thruster shown schematically in FIG. 13 and as a monopropellant in the ACS thruster shown schematically in FIG. 2.

FIG. 14 is a variation of the reduced toxicity fuel dual-mode satellite propulsion system of FIG. 13. Here the hydrogen peroxide 166 is used as a monopropellant in the ACS thruster 30 rather than the reduced toxicity fuel 150. The supplying means 168 supplies the catalytic decomposing element 32 of the ACS thruster 30 with hydrogen peroxide 166, which is decomposed into propellant gases.

Figure 15B:
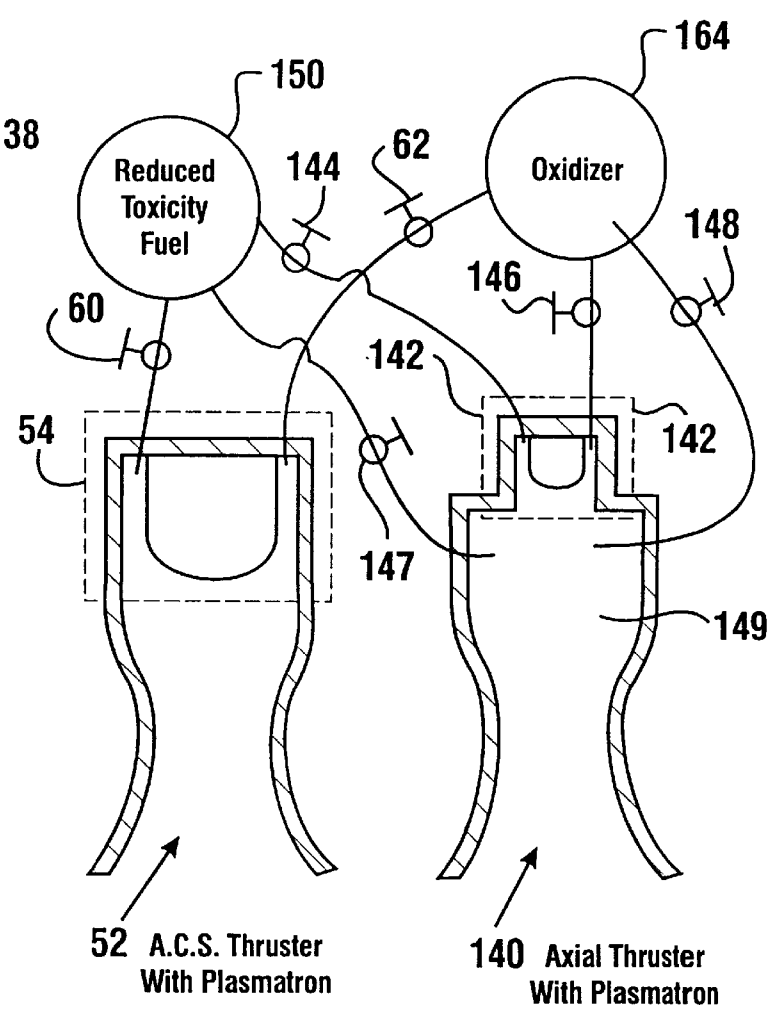
FIG. 15*b* is a schematic view representative of a reduced toxicity dual-mode satellite propulsion system where reduced toxicity propellants are used in both an ACS thruster, as shown in FIG. 4, and the axial thruster shown schematically in FIG. 10.
Figure 15A:
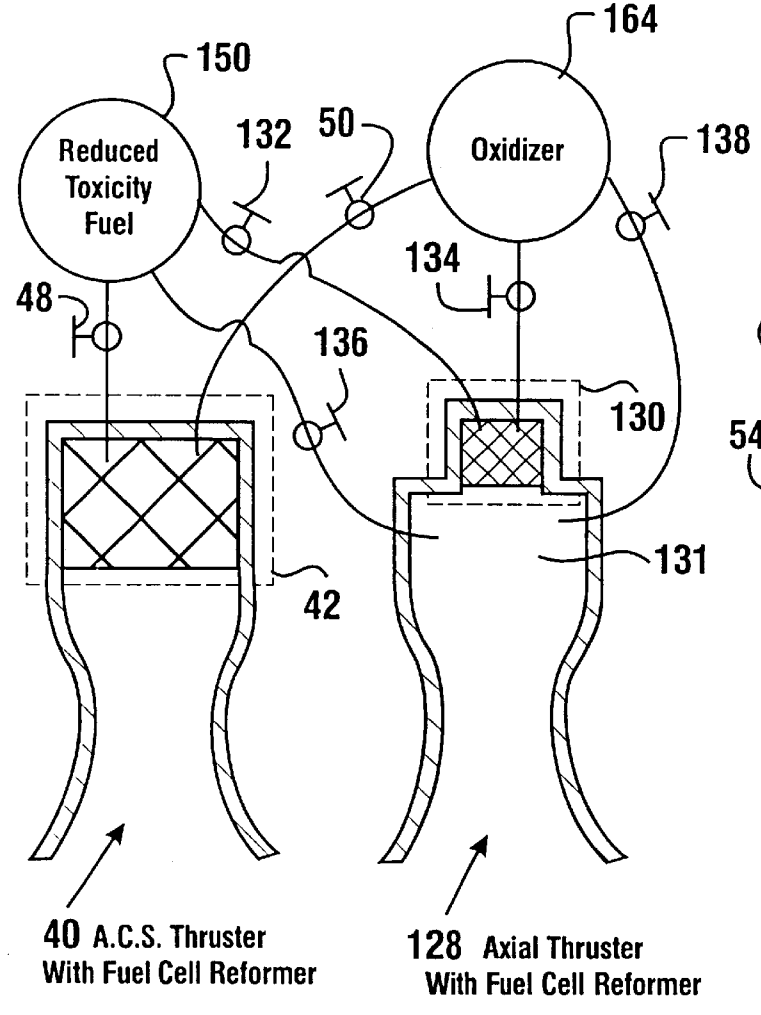
FIG. 15*a* is a schematic view representative of a reduced toxicity dual-mode satellite propulsion system where reduced toxicity propellants are used in both an ACS thruster, as shown in FIG. 3, and the axial thruster shown schematically in FIG. 9.

FIG. 15*a* is a variation of the reduced toxicity fuel, dual-mode satellite propulsion system of FIG. 12*a*. Here the fuel cell reformer is used and the axial thruster is representative of the axial thruster 128 like that shown in FIG. 9. In this embodiment, there are both means 132 for selectively supplying reduced toxicity fuel 150 and means 134 for selectively supplying an oxidizer 164 to the fuel cell reformer 130 used for ignition of the axial thruster. There are also both means 136 for selectively supplying reduced toxicity fuel 150 and means 138 for selectively supplying an oxidizer 164 to the combustion chamber 131 of the axial thruster.

FIG. 15*b* is a variation of the reduced toxicity fuel, dual-mode satellite propulsion system of FIG. 12*b*. Here the plasmatron fuel reformer is used and the axial thruster is representative of the axial thruster 140 like that shown in FIG. 10. In this embodiment, there are both means 144 for selectively supplying reduced toxicity fuel 150 and means 146 for selectively supplying an oxidizer 164 to the plasmatron fuel reformer 142 used for ignition of the axial thruster. There are also both means 147 for selectively supplying reduced toxicity fuel 150 and means 148 for selectively supplying an oxidizer 164 to the combustion chamber 149 of the axial thruster.

Figure 16:
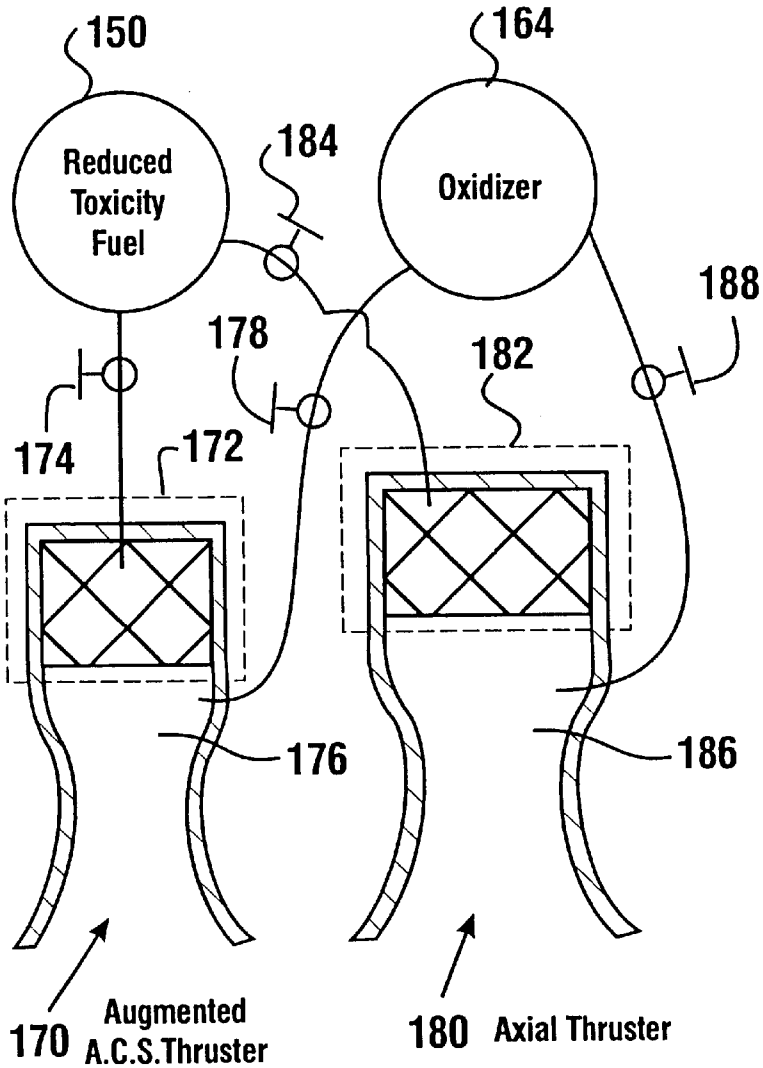
FIG. 16 is a schematic view representative of a reduced toxicity, dual-mode satellite propulsion system with thrusters representative of FIG. 5 used as both an axial thruster and as an augmented ACS thruster.

FIG. 16 is a variation of the reduced toxicity fuel, dual-mode satellite propulsion system of FIG. 1. Thrusters similar to FIG. 5 are used as both an augmented ACS thruster 170 and an axial thruster 180. The augmented ACS thruster is in a lower thrust class than the axial thruster. In this embodiment, there are both means 174 for selectively supplying the reduced toxicity fuel 150 to the decomposing element 172 of the augmented ACS thruster and means 184 for selectively supplying the reduced toxicity fuel 150 to the decomposing element 182 of the axial thruster. There are also both means 178 for selectively supplying the oxidizer 164 directly to the combustion chamber 176 of the augmented ACS thruster and means 188 for selectively supplying the oxidizer 164 directly to the combustion chamber 186 of the axial thruster.

Figure 17B:
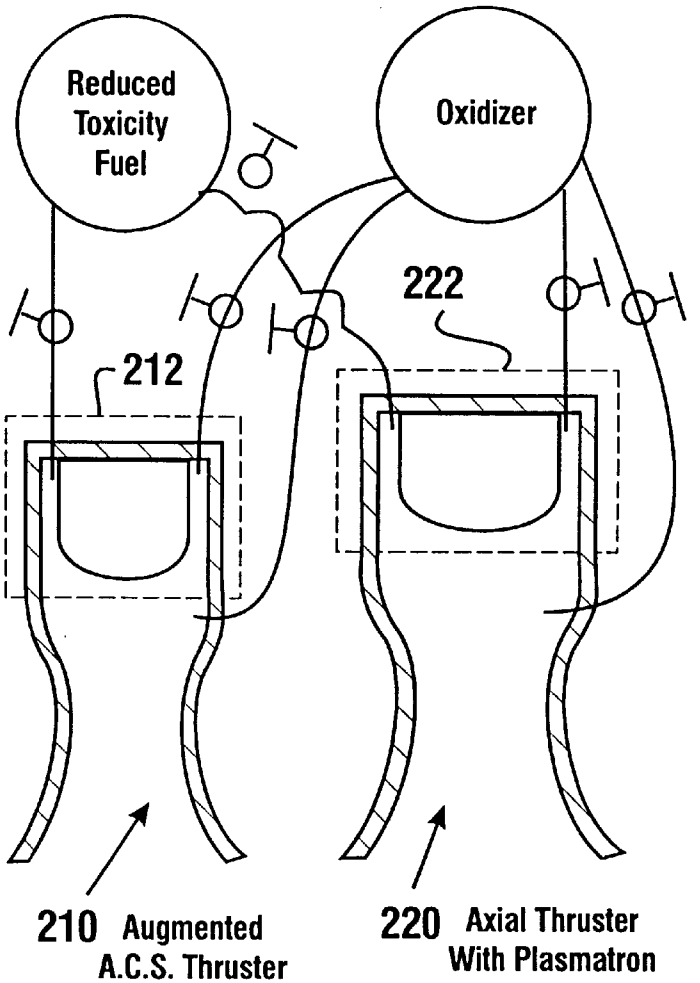
FIG. 17*b* is a schematic view representative of a reduced toxicity, dual-mode satellite propulsion system with thrusters representative of FIG. 7 used as both an axial thruster and as an augmented ACS thruster.
Figure 17A:
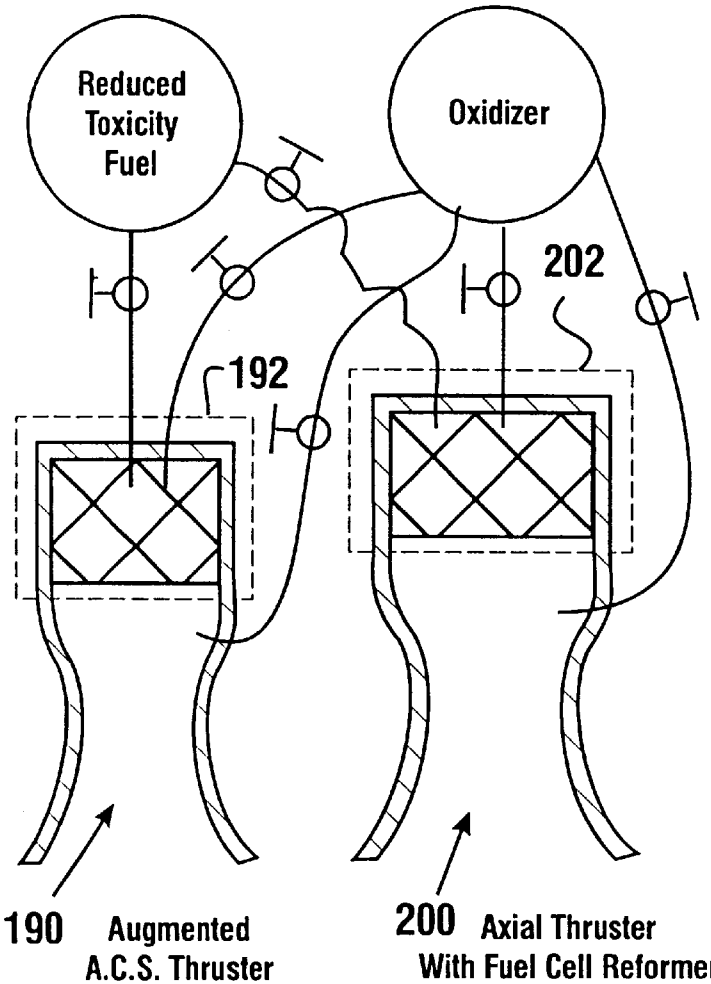
FIG. 17*a* is a schematic view representative of a reduced toxicity, dual-mode satellite propulsion system with thrusters representative of FIG. 6 used as both an axial thruster and as an augmented ACS thruster.

FIG. 17*a* is a variation of the reduced toxicity fuel, dual-mode satellite propulsion system of FIG. 16. Here the fuel cell reformers 192 and 202 are used in the augmented ACS thruster 190 and the axial thruster 200 which are representative of the thruster shown in FIG. 6. The ACS thruster is similar to the axial thruster, but in a lower thrust class.

FIG. 17*b* is a variation of the reduced toxicity fuel, dual-mode satellite propulsion system of FIG. 17*a*. Here plasmatron fuel reformers 212 and 222 are used in the augmented ACS thruster 210 and the axial thruster 220 which are representative of the thruster shown in FIG. 7. The ACS thruster is similar to the axial thruster, but in a lower thrust class.

Figure 18:
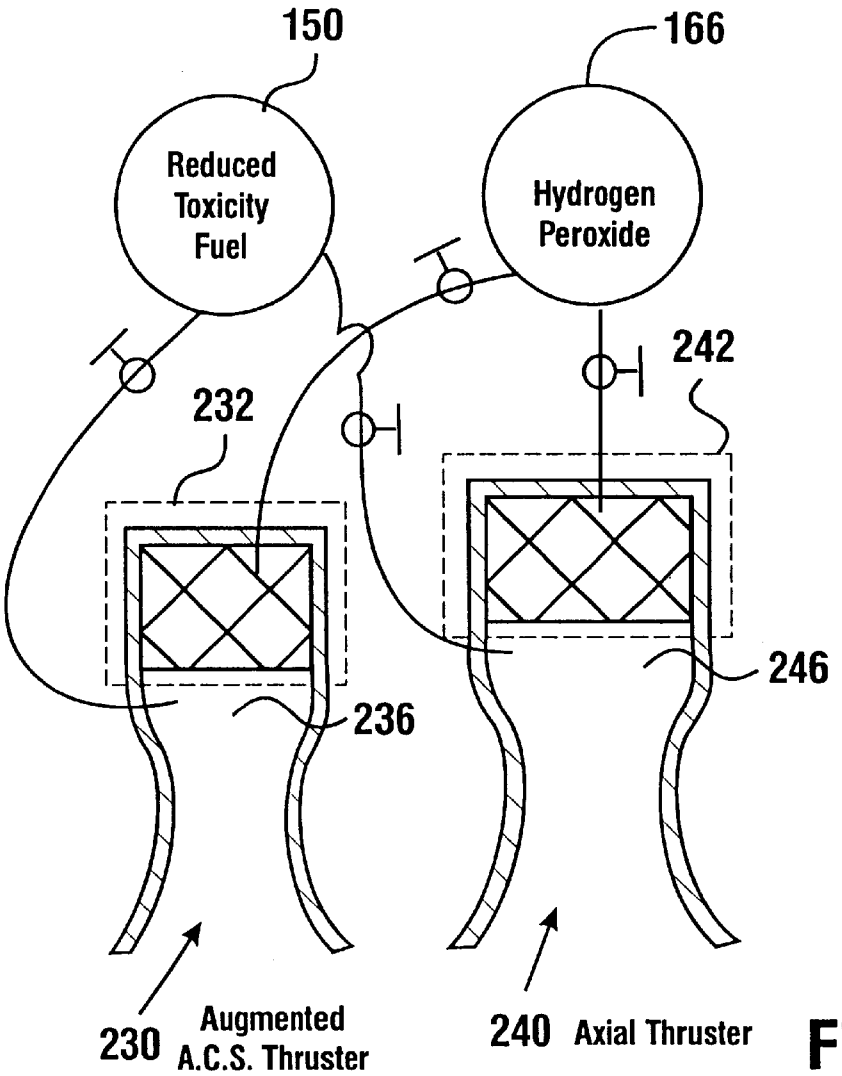
FIG. 18 is a schematic view representative of a reduced toxicity, dual-mode satellite propulsion system similar to FIG. 14, where the ACS thruster is an augmented ACS thruster.

FIG. 18 is a variation of the reduced toxicity fuel, dual-mode satellite propulsion system of FIG. 14. Here the augmented ACS thruster 230 and axial thruster 240 are representative of the thruster shown in FIG. 5. The augmented ACS thruster is similar to the axial thruster, but in a lower thrust class. Here hydrogen peroxide 166 is selectively supplied to the catalytic decomposing elements 232 and 242 and the reduced toxicity fuel 150 is selectively supplied to the combustion chambers 236 and 246.

Figure 19:
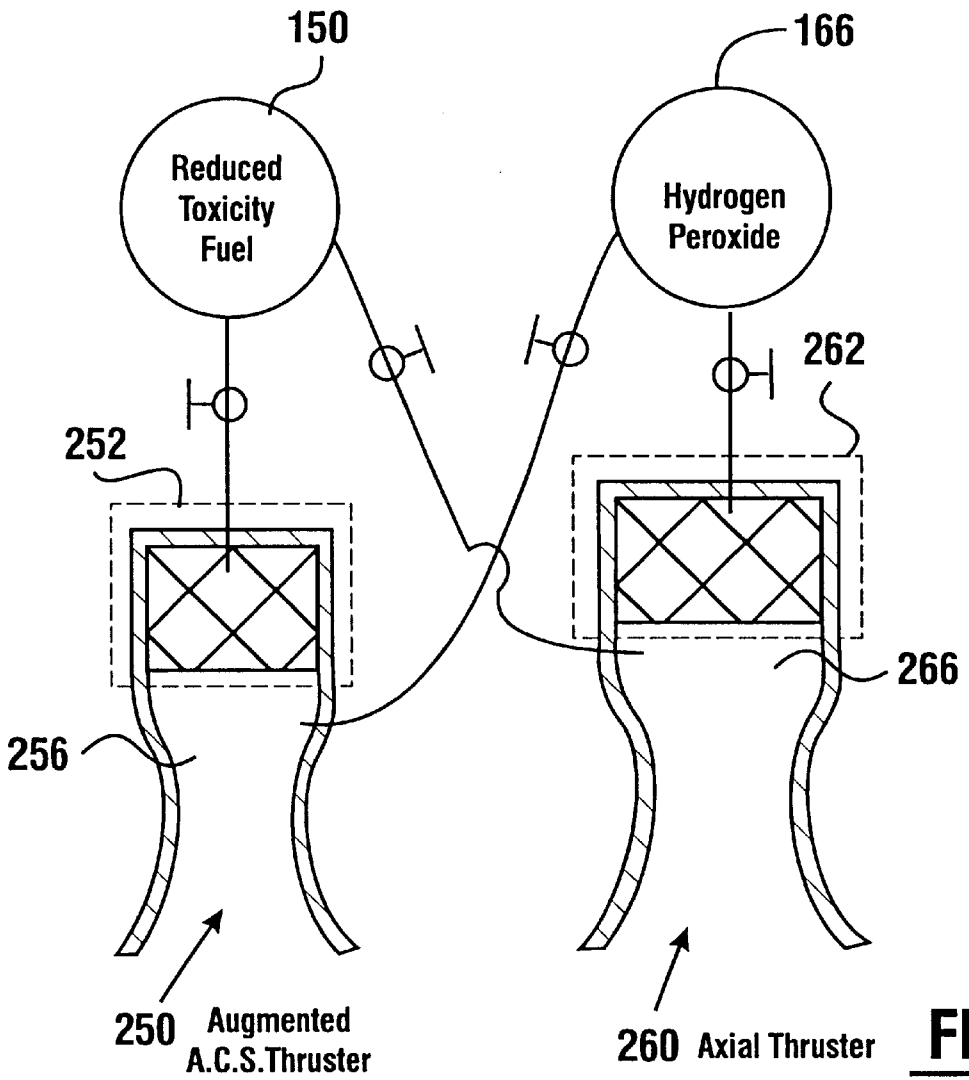
FIG. 19 is a schematic view representative of a reduced toxicity, dual-mode satellite propulsion system similar to FIG. 13, where the ACS thruster is an augmented ACS thruster.

FIG. 19 is a variation of the reduced toxicity fuel, dual-mode satellite propulsion system of FIG. 13. Here the augmented ACS thruster 250 and axial thruster 260 are representative of the thruster shown in FIG. 5. The augmented ACS thruster is similar to the axial thruster but in a lower thrust class. Here hydrogen peroxide 166 is selectively supplied to the combustion chamber 256 of the augmented ACS thruster 250 and is selectively supplied to the decomposing element 262 of the axial thruster 260. The reduced toxicity fuel 150 is selectively supplied to the decomposed element 252 of the augmented ACS thruster 200 and to the combustion chamber 266 of the axial thruster 260.

Figure 20:
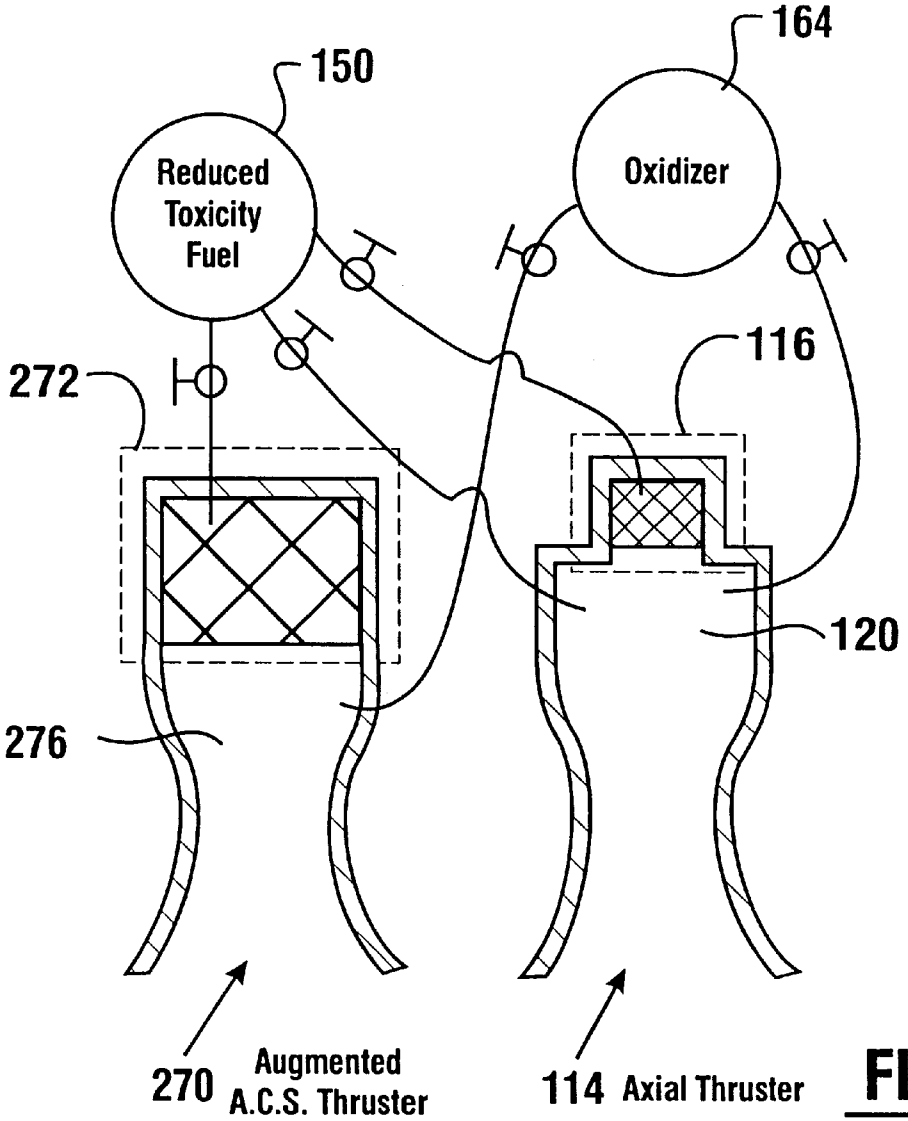
FIG. 20 is a schematic view representative of a reduced toxicity, dual-mode satellite propulsion system similar to FIG. 11, where the ACS thruster is an augmented ACS thruster.

FIG. 20 is a variation of the reduced toxicity fuel, dual-mode satellite propulsion system of FIG. 11. Here the augmented ACS thruster 270 is similar to the thruster shown in FIG. 5. Oxidizer 164 is selectively supplied to the combustion chamber 276 of the augmented ACS thruster 270. Reduced toxicity fuel is selectively supplied to the decomposing element 272 of the augmented ACS thruster 270.

Figure 21B:
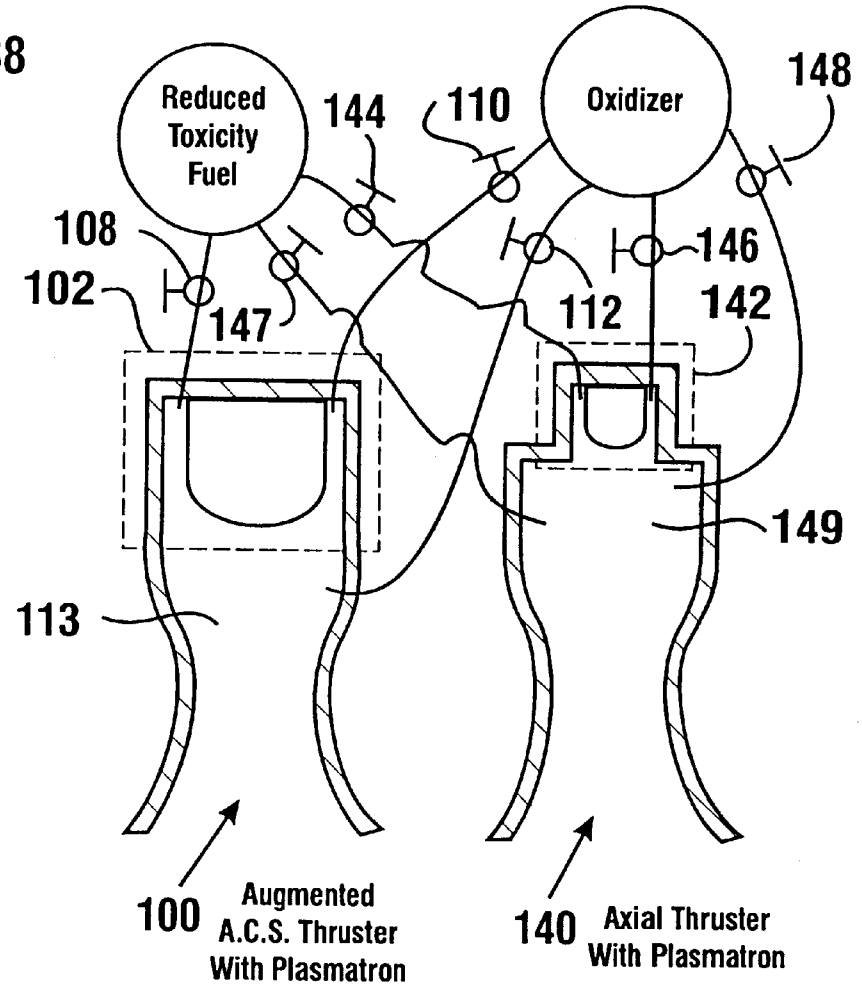
FIG. 21*b* is a schematic view representative of a reduced toxicity, dual-mode satellite propulsion system similar to FIG. 15*b* where the ACS thruster is an augmented ACS thruster.
Figure 21A:
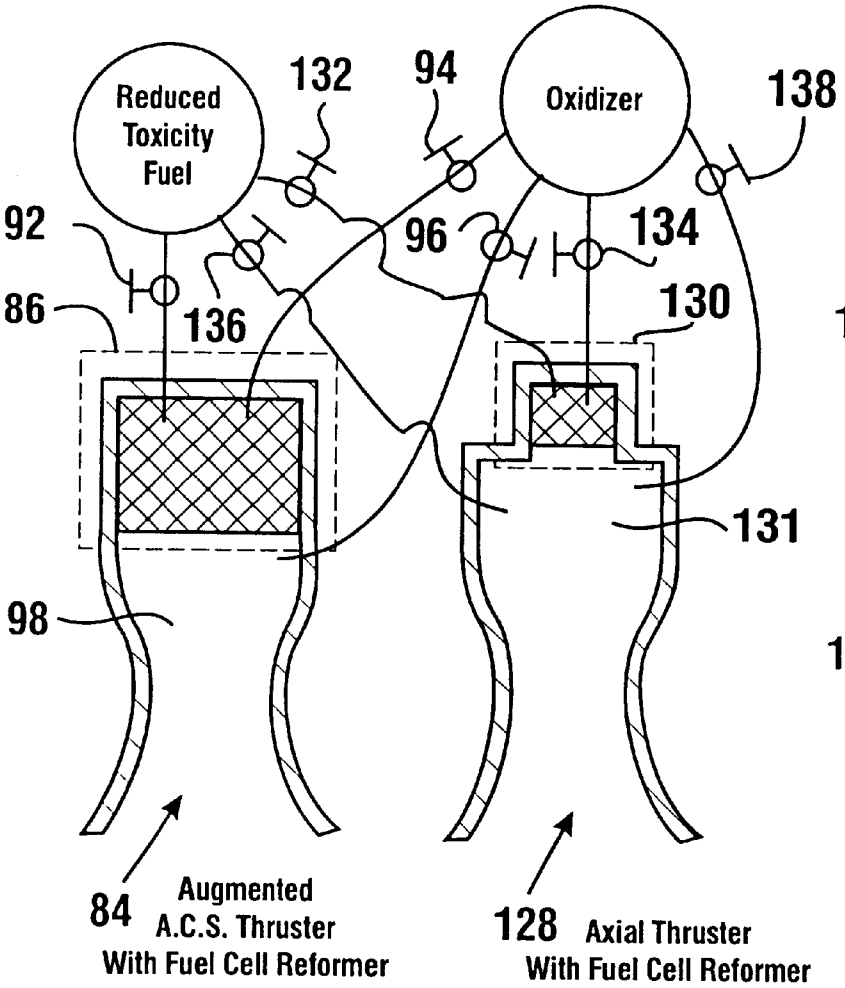
FIG. 21*a* is a schematic view representative of a reduced toxicity, dual-mode satellite propulsion system similar to FIG. 15*a* where the ACS thruster is an augmented ACS thruster.

FIG. 21*a* is a variation of the reduced toxicity fuel, dual-mode satellite propulsion system of FIG. 15*a*. Here the augmented ACS thruster 84 is similar to the thruster shown in FIG. 6.

FIG. 21*b* is a variation of the reduced toxicity fuel, dual-mode satellite propulsion system of FIG. 15*b*. Here the augmented ACS thruster 100 is similar to the thruster shown in FIG. 7.

The dual-mode propulsion systems depicted by FIGS. 1 and 11–21 are representative of some of the embodiments of the reduced toxicity thrusters of the present invention. Other combinations of the reduced toxicity fuel thrusters described above are also encompassed by the present invention.

The exemplary embodiments of the reduced toxicity fuel satellite propulsion system described herein have been described with reference to particular nontoxic propellants and decomposing elements. Other embodiments of the invention may include other or different nontoxic propellants and decomposing elements which provide similar performance characteristics.

Thus the reduced toxicity fuel satellite propulsion system of the present invention achieves the above state objectives, eliminates difficulties encountered in the use of prior devices and systems, solves problems and attains the desired results described herein.

In the foregoing description certain terms have been used for brevity, clarity and understanding. However, no unnecessary limitations are to be implied therefrom because such terms are for descriptive purposes and are intended to be broadly construed. Moreover the descriptions and illustrations herein are by way of examples and the invention is not limited to the details shown and described.

In the following claims any feature described as means for performing a function shall be construed as encompassing any means capable of performing the recited function and shall not be deemed limited to the particular means shown in the foregoing description or mere equivalents thereof.

Having described the features, discoveries and principles of the invention, the manner in which it is constructed and operated and the advantages and useful results attained; the new and useful structures, devices, elements, arrangements, parts, combinations, systems, equipment, operations, methods, processes and relationships are set forth in the appended claims.

I claim:

1. A method for propelling a satellite comprising the steps of:

supplying a thruster with a first reduced toxicity propellant, wherein the first propellant includes methanol;

decomposing the first propellant into hot gases;

supplying the thruster with a second propellant, wherein the second propellant includes liquid oxygen;

combining the hot gases with the second propellant inside a combustion chamber of the thruster, whereby the second propellant and hot gases auto-ignite and produce thrust for maneuvering the satellite.

2. A reduced toxicity fuel satellite propulsion system comprising:

a first reduced toxicity liquid propellant supply, wherein the first propellant includes a reduced toxicity satellite fuel;

a thruster, wherein the thruster includes a decomposing element, wherein the decomposing element is operative to decompose the propellant; and wherein the decomposing element includes a fuel cell reformer;

means for selectively supplying the propellant to the decomposing element, whereby the propellant is decomposed into hot gases;

a second liquid propellant supply, wherein the second propellant includes an oxidizer;

a second supplying means for selectively supplying the second propellant to the thruster, and wherein the second supplying means is operative to selectively supplying the oxidizer to the fuel cell reformer.

3. The reduced toxicity fuel satellite propulsion system as recited in claim 2, wherein the fuel cell reformer includes a porous catalyst bed for receiving the satellite fuel and the oxidizer, and wherein the fuel cell reformer includes resistive heaters for heating the satellite fuel and the oxidizer.

4. The reduced toxicity fuel satellite propulsion system as recited in claim 2 wherein the satellite fuel is selected from the group consisting of alcohols, ethers and saturated hydrocarbons.

5. The reduced toxicity fuel satellite propulsion system as recited in claim 3 wherein the satellite fuel includes methanol.

6. The reduced toxicity, satellite propulsion system as recited in claim 5 wherein:

the thruster further includes a combustion chamber;

the decomposing element is operative to output the hot gas into the combustion chamber;

the second supplying means is operative to selectively supply the second propellant to the combustion chamber of the thruster, whereby the second propellant and the hot gases auto-ignite and produce thrust for maneuvering the satellite.

* * * * *